US006087575A

United States Patent [19]

Niitsuma

[11] Patent Number: 6,087,575

[45] Date of Patent: Jul. 11, 2000

[54] KEYBOARD DEVICE FOR KEYBOARD-BASED MUSICAL INSTRUMENT

[75] Inventor: Shinji Niitsuma, Shizuoka-ken, Japan

[73] Assignee: Kabushiki Kaisha Kawai Gakki Seisakusho, Hamamatsu, Japan

[21] Appl. No.: 09/366,541

[22] Filed: Aug. 4, 1999

[51] Int. Cl.[7] ..... G10C 3/12

[52] U.S. Cl. ..... 84/423 R; 84/432; 84/438

[58] Field of Search ..... 84/423 R, 424, 84/425, 432, 438

[56] References Cited

U.S. PATENT DOCUMENTS 5,406,875 4/1995 Tami et al. ..... 84/433

*Primary Examiner*—Stanley J. Witkowski
*Assistant Examiner*—Shih-Yung Hsieh
*Attorney, Agent, or Firm*—Evenson, McKeown, Edwards & Lenahan, P.L.L.C.

[57] ABSTRACT

A keyboard device for a keyboard-based musical instrument comprises a plurality of chassis arranged in a left-to-right direction, and a plurality of keys attached to the plurality of chassis for pivotal movements and arranged in the left-to-right direction. The overall chassis for the keyboard device is divided into a plurality of chassis which can be separately manufactured, so that the size of each chassis can be reduced as compared with a conventional keyboard device for which a single chassis is manufactured. Since this results in a reduction in scale of manufacturing facilities including a mold and a press machine used for manufacturing the chassis, and easier adjustments to the mold in a trial manufacturing stage, a manufacturing cost of the chassis, i.e., a manufacturing cost of the keyboard device can be reduced.

21 Claims, 18 Drawing Sheets

KEYBOARD DEVICE FOR KEYBOARD-BASED MUSICAL INSTRUMENT

BACKGROUND OF THE INVENTION

1. Field of the Invention

The present invention relates to a keyboard device for use with a musical instrument having a keyboard such as an electronic piano or the like.

2. Description of the Related Art

Conventionally, keyboard devices for keyboard-based musical instruments of the type mentioned above are known, for example, as described in Laid-open Japanese Patent Application No. 63-128397. The keyboard device disclosed therein has a large number of keys arranged in the left-to-right direction on a single chassis (frame) made of metal. The chassis is formed with a large number of grooves and holes such that the respective keys are pivotably attached to the chassis while they remain engaged with the grooves and holes associated therewith. The chassis is integrally fabricated by punching a single metal plate (for example, a steel plate) using a press tool and bending the punched metal plate using a bending tool.

Some keyboard devices employ a chassis made of a synthetic resin in place of a metal chassis. The synthetic resin chassis as mentioned may be injection molded by an injection molding machine comprising an injection molding tool.

The above-mentioned keyboard device has all keys carried on a single chassis, so that the chassis has a size larger than the width (the length in the left-to-right direction) of all the keys. This leads to requirements to larger manufacturing facilities including a press tool, a bending tool, a mold for injection molding, a press machine, an injection molding machine, and so on, all of which must be used during machining of the chassis, thereby resulting in an increased manufacturing cost. In addition, in a trial manufacturing stage, holes and key guides formed in the chassis may deviate from the positions at which they should be, due to manufacturing errors in tools and molds, in which case the tools and molds must be adjusted for correcting deviated positions, if any. In this event, as the tools and molds are large, positionally deviated grooves and holes must be adjusted over a wider range, thereby incurring a problem that the adjustments for the tools and molds require significant time and labor, and as a result the manufacturing cost is further increased.

Generally, keyboard devices are not limited to normal ones having 88 keys but may have a variety of numbers of keys. For this reason, tools and molds, if fabricated for machining a chassis for a keyboard device having 88 keys, by way of example, cannot be diverted to the machining of a chassis for a keyboard device having 76 keys. Consequently, various kinds of tools and molds must be individually fabricated in order to manufacture a variety of chassis for musical instruments having different numbers of keys, thereby causing a further increase in the manufacturing cost.

OBJECT AND SUMMARY OF THE INVENTION

The present invention has been made to solve the problems mentioned above, and its object is to provide a keyboard device for a keyboard-based musical instrument which is capable of achieving a significant reduction in manufacturing cost thereof resulting from a significant reduction in manufacturing cost of a chassis, facilitating the assembly thereof, and further reducing the manufacturing cost thereof by reducing the number of parts such as a supporting mechanism associated with keys.

To achieve the above object, in a first aspect of the present invention, a keyboard device for a keyboard-based musical instrument comprises a plurality of chassis arranged in a left-to-right direction, and a plurality of keys attached to the plurality of chassis for pivotal movements, and arranged in the left-to-right direction.

According to this keyboard device for a keyboard-based musical instrument, the overall chassis for the keyboard device is divided into a plurality of chassis which can be separately manufactured, so that the size of each chassis can be reduced as compared with a conventional keyboard device for which a single chassis is manufactured. Since this results in a reduction in scale of manufacturing facilities including a mold and a press machine used for manufacturing the chassis, and easier adjustments to the mold in a trial manufacturing stage, a manufacturing cost of the chassis, i.e., a manufacturing cost of the keyboard device can be reduced.

In this case, at least a portion of the plurality of chassis preferably comprises a plurality of chassis of a single type having the same dimensions and shape.

According to this structure, common chassis can be used to assemble a keyboard device, so that the types of molds used in manufacturing the chassis can be reduced. This can further promote a reduction in the manufacturing cost.

Further, in this case, the chassis of the single type are preferably combined to be an overall chassis for carrying keys which span an integer multiple of one octave.

In general keyboard devices, the arrangement of white keys and black keys are repeated every octave, the overall chassis may be divided in octaves, as in the keyboard device for a keyboard-based musical instrument of the present invention, to readily provide a common chassis in a keyboard device. In addition, when the white keys and the black keys are also standardized in terms of dimensions and shapes, one type of chassis can be applied to a variety of keyboard devices having different numbers of keys. It is therefore possible to significantly reduce the manufacturing cost of keyboard devices for keyboard-based musical instruments. Particularly, when the overall chassis is divided into chassis associated with keys for one octave, a majority of keyboard sections in a keyboard device can be implemented by one type of chassis, and the chassis can be applied in a maximally extended range of the keyboard devices.

In the cases mentioned above, the plurality of chassis are preferably attached to a main body of the keyboard-based musical instrument.

In this structure, the plurality of chassis can be directly attached to the body of the musical instrument without using particular parts, so that the number of parts can be reduced.

Also, preferably, the keyboard device of the first aspect further comprises a coupling member for coupling the plurality of chassis to one another.

According to this structure, since the plurality of chassis are coupled to each other with the coupling member, the degree of freedom in assembling the keyboard device can be increased, for example, keys can be attached to the plurality of chassis coupled with the coupling member before the chassis are placed on the main body of the musical instrument. Then, the assembling of the keyboard device in this way separately from the main body of the musical instrument, before it is carried on the main body of the musical instrument, can facilitate works involved in the assembling of the keyboard device, and works involved in adjustments to positional relationships between the plurality of chassis and between keys attached on the chassis, and so on. It is therefore possible to avoid possible damages on the surfaces of the keys which are highly likely to occur when the chassis, the keys and so on are sequentially assembled on the main body of the musical instrument.

In this case, preferably, the keyboard device further comprises a plurality of resilient springs retained by the coupling means respectively for urging the plurality of keys such that the keys return to respective key released positions.

According to this structure, since the resilient spring for returning the key to a key released position is retained by the rear coupling member, a spring retaining member, which has been conventionally required for this purpose, can be eliminated to correspondingly reduce the number of parts, thereby further reducing the manufacturing cost.

Alternatively, each of the plurality of chassis includes engaging means at a predetermined position, and the coupling member includes a plurality of positioning means for positioning the plurality of chassis by engaging the engaging portions of the plurality of chassis at the predetermined positions.

According to this structure, when the chassis are coupled with the coupling members, the engaging means are engaged with the associated positioning means of the coupling member to allow for highly accurate and easy mutual positioning of the plurality of chassis through the coupling members. This further facilitates works associated with the assembly of the chassis.

In this case, the engaging means of the plurality of chassis preferably includes projections and/or recesses, and the positioning means of the coupling member includes recesses and/or projections which are engageable with the projections and/or recesses of the engaging means of the plurality of chassis.

In this structure, the plurality of chassis can be positioned with the coupling member in a relatively simple configuration consisting of the projections and recesses.

Alternatively, the coupling member preferably includes a portion extending at least in the vertical direction for suppressing deflection of the plurality of chassis.

According to this structure, since the coupling member includes the vertically extending portion, the rigidity of the chassis can be enhanced, thereby making it possible to suppress deflection of the chassis in the left-to-right direction. In this way, since the coupling member can be utilized also as a reinforcing member for the chassis, this leads to elimination of additional reinforcing members, and ribs integrally formed with the chassis, for adding the rigidity of the chassis. As a result, a reduction in the number of parts and a simplification of a mold in shape can be provided, thereby reducing the manufacturing cost.

In this case, preferably, the keyboard device further comprises a printed circuit board attached to the plurality of chassis for detecting key pressing information for the plurality of keys, wherein the coupling member is disposed near the printed circuit board.

In this structure, the coupling member and the printed circuit board exhibit deformation in cooperation against a load acting on the printed circuit board, resulting from a key pressing operation or the like. Stated another way, the rigidity of the printed circuit board is reinforced by the coupling member. As a result, it is possible to obviate troubles such as malfunctions due to disconnection, short-circuiting, and so on caused by deflection, deformation or the like of the printed circuit board, thereby improving the durability of the keyboard device.

In the cases mentioned above, preferably, the keyboard device further comprises a plurality of hammers pivotably supported by respective hammer fulcrums defined on the plurality of chassis, and arranged for pivotal movements in association with the plurality of keys, wherein the coupling member is disposed near the hammer fulcrums.

In this structure, the coupling member and the plurality of chassis exhibit deformation in cooperation against a load acting on the hammer fulcrum, resulting from a key pressing operation or the like. Stated another way, the rigidity of the plurality of chassis near the hammer fulcrums is reinforced by the coupling member to suppress deflection and deformation of the chassis near the hammer fulcrums. As a result, it is possible to obviate the occurrence of variations in strokes of pivotal movements of the hammers, shaking of the hammers, and so on.

Alternatively, the keyboard device further comprises a plurality of hammers pivotably supported by the coupling member, and arranged for pivotal movements in association with the plurality of keys.

According to this structure, since the hammers are directly supported by the coupling member, hammer supporting members, which have been conventionally required for this purpose, can be eliminated to correspondingly reduce the number of parts, thereby further reducing the manufacturing cost.

In this case, the coupling member preferably includes a single coupling member continuously extending in the left-to-right direction over all of the plurality of hammers.

In this structure, since the coupling member is configured as a single coupling member extending over all the hammers, the hammers are uniformly supported in terms of position over the entire keyboard device, without being affected by an assembling accuracy of the plurality of chassis. This results in significantly small variations in the height, mutual interval, stroke and so on of the hammers, thereby making it possible to extremely readily adjust these items.

Further in this case, the coupling means preferably includes a horizontal attaching portion attached to the plurality of chassis, and a hammer supporting portion extending upwardly from one end of the attaching portion, wherein the hummer supporting portion is formed with alternating engaging projections and engaging recesses along a lengthwise direction of the coupling member for engaging and supporting the plurality of hammers.

In this structure, the coupling member is formed in an angular L-shape in cross-section with the attaching portion and the hammer supporting portion, and the plurality of hammers are engaged with and supported by the plurality of engaging protrusions and engaging recesses formed in a comb shape in the hammer supporting portion. Thus, the plurality of hammers can be supported at uniform supporting positions with the coupling member of such a relatively simple and inexpensive structure. Furthermore, since the coupling member formed in an L-shape in cross-section has a relatively high rigidity, a reinforcing function of the chassis can also be enhanced.

Alternatively, the coupling member preferably includes a printed circuit board associated with a key switch for detecting key pressing information for the plurality of keys.

According to this structure, since the plurality of chassis are mutually coupled utilizing the printed circuit board associated with the key switch generally provided in an electronic piano, separate coupling members for coupling the chassis are eliminated to correspondingly reduce the number of parts, thereby making it possible to further reduce the manufacturing cost. In addition, such coupling of chassis with the printed circuit board means that the key switches are simultaneously attached to the chassis. In other words, the coupling of the chassis can be carried out simultaneously with the attachment of the key switch, so that the simplification can be further promoted in assembling the keyboard device.

Alternatively, the coupling means is preferably made of metal, and the keyboard device further comprises screws which are screwed into the coupling means from a main body side of the keyboard device to secure the plurality of chassis to the main body of the keyboard device.

According to this structure, the chassis are secured to the main body of the musical instrument with the screws which are screwed into the metal coupling member from the main body side of the musical instrument, so that a sufficient holding force imparted by screws enables the keyboard device to be firmly secured to the main body of the musical instrument while preventing troubles such as shaky screws or the like. Also, this structure eliminates separate attaching members, which have conventionally been required for this purpose, to correspondingly reduce the number of parts and the number of assembling steps, thereby making it possible to further reduce the manufacturing cost.

Alternatively, the coupling means preferably includes a single coupling means continuously extending in the left-to-right direction, and at least one of a plurality of key guides for guiding the plurality of keys to pivot, and key stoppers for regulating the range of pivotal movements of the plurality of keys.

According to this structure, the provision of the plurality of key guides and/or key stoppers for the coupling member eliminates the need for adjustments to a mold for the chassis for making uniform the positions of key guides. Also, since the single coupling member continuously extends in the left-to-right direction, all the key guides can be set at appropriately defined intervals therebetween only by coupling a plurality of chassis by the coupling member, irrespective of an assembling accuracy of the chassis, if the coupling member has been previously provided with the key guides. Since this eliminates the need for positional adjustments to the key guides after the chassis have been coupled, the assembly of the keyboard device is further facilitated. Similarly to this, if the coupling member has been previously provided with key stoppers of uniform shape and dimensions, all the keys can be pivoted over a uniform range regulated by the key stoppers only by coupling the plurality of chassis with the coupling member. Since this eliminates the need for positional adjustments to the key stoppers for making uniform the strokes of pivotal movements of all the keys, after the chassis have been coupled, the keyboard device can be assembled more easily.

Alternatively, it is preferable that the keyboard device further comprises a plurality of hammers pivotably attached to the plurality of chassis, and arranged for pivotal movements in association with the plurality of keys, wherein the coupling member includes a single coupling member continuously extending in the left-to-right direction, and hammer stoppers for regulating the range of pivotal movements of the plurality of hammers.

According to this structure, since the hammer stoppers are provided to the single coupling member continuously extending in the left-to-right direction, all the hammers can be pivoted over a uniform range regulated by the hammer stoppers only by coupling the plurality of chassis with the coupling member if the hammer stoppers are made in uniform shape and dimensions. Since this eliminates the need for positional adjustments to the hammer stoppers for making uniform the strokes of pivotal movements of all the hammers, after the chassis have been coupled, the keyboard device can be assembled more easily.

Also, to achieve the above object, in a second aspect of the present invention, a keyboard device for a keyboard-based musical instrument comprises a plurality of chassis arranged in a left-to-right direction, a coupling member extending in the left-to-right direction for coupling the plurality of chassis to one another, and a plurality of keys attached to the plurality of chassis for pivotal movements and arranged in the left-to-right direction.

According to this structure, the keyboard device of the second aspect can have the advantage provided by composing the overall chassis of a plurality of chassis, and the advantage provided by coupling these chassis with the coupling member in a manner similar to the keyboard device of the first aspect. In addition, since the keys are directly supported by the coupling member, key supporting members, which have conventionally been provided for this purpose, can be eliminated to correspondingly reduce the number of parts, thereby further reducing the manufacturing cost.

In this case, the coupling member preferably includes a single coupling member continuously extending in the left-to-right direction over all of the plurality of keys.

In this structure, since the coupling member is configured as a single coupling member extending over all the keys, the positions of the key fulcrums for the respective keys are uniformly defined over the entire keyboard device without being affected by an assembling accuracy of the plurality of chassis. This results in significantly small variations in the height, mutual intervals, stroke and so on of the keys, thereby making it possible to extremely readily adjust these items.

In the cases mentioned above, preferably, the keyboard device further comprises a plurality of resilient springs retained by the coupling means respectively for urging the plurality of keys such that the keys return to respective key released positions.

In this structure, since the resilient springs are retained by the coupling member which is also utilized as a spring retaining member, conventional spring retaining members can also be omitted to correspondingly reduce the number of parts, thereby further reducing the manufacturing cost.

DESCRIPTION OF THE PREFERRED EMBODIMENTS

Figure 1:
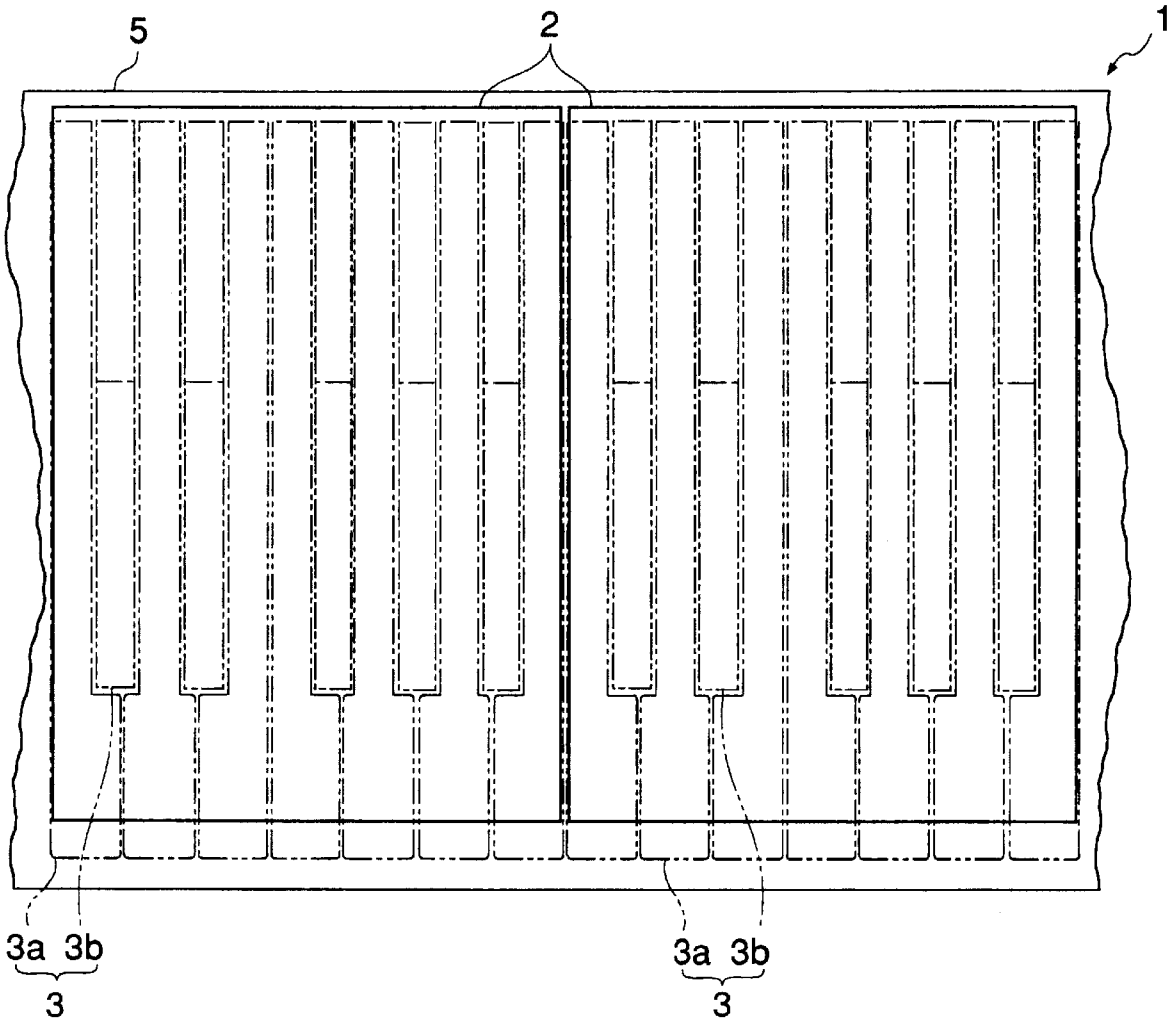
FIG. 1 is a top plan view of a partially omitted keyboard device for an electronic piano according to a first embodiment of the present invention.
Figure 2:
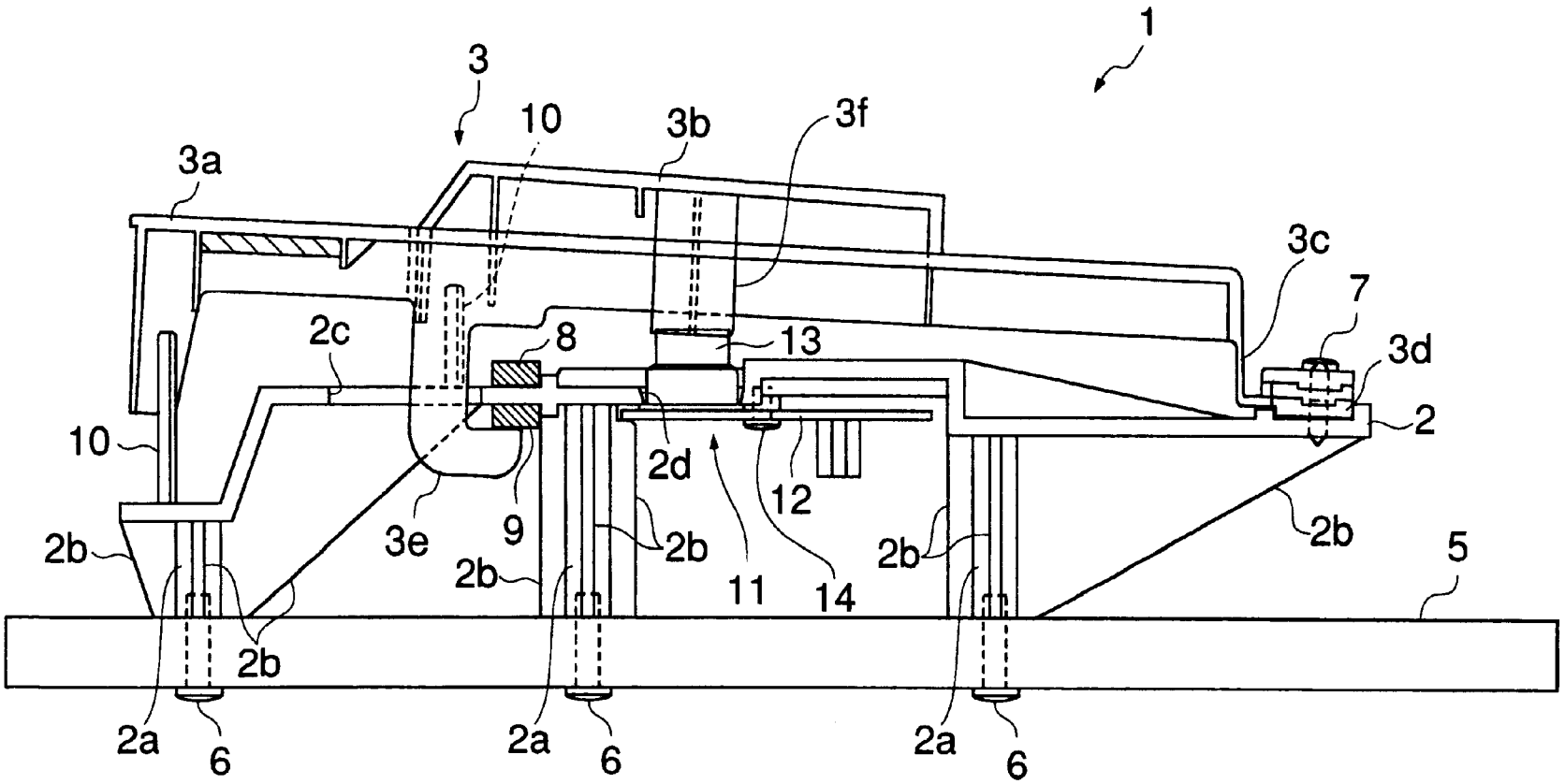
FIG. 2 is a side cross-sectional view of the keyboard device of FIG. 1.

Several embodiments of the present invention will hereinafter be described with reference to the accompanying drawings. It should be first noted that although keyboard devices described below may be classified into several different types, they are all suitable for use with electronic pianos. FIGS. 1 and 2 illustrate a first embodiment in which the present invention is applied to a first type of keyboard device. The illustrated keyboard device 1 has nine chassis 2 carried on a keybed (main body of a musical instrument) in a left-to-right direction. Specifically, seven chassis 2 (only two of which are illustrated in FIG. 1) and sub-chassis for a highest sound range and a lowest sound range (both of which are not shown in FIG. 1) are carried on the keybed 5. Each of the seven chassis 2 comprises a uniform chassis having the same dimensions and the same shape, and keys 3 for one octave arranged thereon, i.e., 12 keys 3 consisting of seven white keys 3*a* and five black keys 3*b*. In addition, the sub-chassis for the highest sound range and the lowest sound range have three keys 3 and one key 3 arranged thereon, respectively. Thus, the keyboard device 1 totally has 88 keys 3 (only 24 of which are illustrated in FIG. 1).

The chassis 2 may be formed, for example, of an injection molding made of ABS resin, and into a rectangular plane shape. As illustrated in FIG. 2, the chassis 2 is formed with two sets of three bosses, projecting downwardly from the bottom thereof along the left and right edges (only one set of bosses are illustrated in FIG. 2). Specifically, one set of three bosses includes front, intermediate and rear bosses 2*a* arranged in a line in a front-to-rear direction of the chassis 2 (the left-to-right direction in FIG. 2). Thus, each chassis 2 is provided with a total of six bosses. Each of bosses 2*a* is formed integrally with four ribs 2*b* for reinforcement which extend in the front-to-rear and left-to-right directions (only three of which are shown). The keybed 5, on the other hand, is formed of an extrusion molding made, for example, of aluminum alloy, and has a plurality of holes, not shown, formed at predetermined positions corresponding to the bosses 2*a* of the chassis 2. The chassis 2 are firmly secured to the keybed 5 by inserting screws 6 through these holes, and screwing the screws 6 into holes, not shown, formed in the bosses 2*a*.

The sub-chassis for the highest sound range and the lowest sound range are fabricated by injection molding a chassis having a V-shaped groove using a mold for the chassis 2 and a lining piece, and cutting the resulting grooved chassis along the groove.

The white keys 3*a* and the black keys 3*b* are each formed of an injection molding made, for example, of ABS resin. In the following, the structure of the white key 3*a* will be described. The white key 3*a* is formed on the rear end thereof with a flexible portion 3*c* extending downwardly, and a mount 3*d* extending rearwardly from the flexible portion 3*c*. The mount 3*d* is secured to the top of the chassis 2 in a rear end portion with a screw 7. The flexible portion 3*c* has such a thickness that may cause elastic deformation resulting in flexure when the white key 3*a* is pressed. The chassis 2 is provided with a lower limit stopper 8 and an upper limit stopper 9, made of rubber, attached on the top and the bottom of the chassis 2 in a central portion thereof, rather near the front. Further, the white key 3*a* is formed with a hook-like stopper member 3*e* in a central portion thereof near the front. The stopper member 3*e* extends through a hole 2*c* of the chassis 2 and projects downwardly, such that its leading end normally abuts to the upper stopper 9. With the foregoing structure, the white key 3*a* is arranged for pivotal movement between a key released position (the position illustrated in FIG. 2) at which the white key 3*a* is rearwardly inclined with the stopper member 3*e* abutting to the upper limit stopper 9, and a key pressed position (not shown) at which the bottom of the white key 3*a* abuts to the lower limit stopper 8. Normally, the white key 3*a* remains at the key released position.

A front end portion of the chassis 2 forms a step which is lower than the remaining portion, and a key guide 10 is implanted on the step for guiding pivotal movements of the white key 3*a*. The key guide 10 guides the white key 3*a*, when it is pivoted, without shaking in the left-to-right direction.

The chassis 2 is provided with a key switch 11 in a central portion thereof. The key switch 11 comprises a printed circuit board 12 secured to the bottom of the chassis 2 with a screw 14, and a switch body 13 carried on the top of the printed circuit board 12. The switch body 13 projects upwardly through a hole 2*d* formed through the chassis 2. The switch body 13 is also connected to a controller (not shown) for controlling the generation of sound from an electronic piano, through the printed circuit board 12. The white key 3*a*, in turn, is formed in a central portion with an actuator 3*f* which projects downwardly into abutment to the top of the switch body 13. When the white key 3*a* is pressed to cause the switch body 13 to move down and therefore turn on, information on pressing of the key 3 is detected for controlling the generation of sound. The white key 3*a* is built as described above. The black key 3*b* is also built substantially in a similar manner to the white key 3*a*, though description thereof is omitted.

The keyboard device 1 built as described above has the overall chassis for arranging the keys 3 thereon divided into seven chassis 2 for one octave, and two sub-chassis for the lowest sound range and the highest sound range, so that the keyboard device 1 only requires smaller manufacturing facilities, for use in manufacturing the chassis 2, including a mold for injection molding, and an injection molding machine. In addition, a smaller mold facilitates adjustments therefor in a trial manufacturing stage. Further, since the seven chassis 2 for arranging keys 3 for one octave are built in the same structure, a common mold may only be required for manufacturing the chassis 2. Furthermore, since the sub-chassis for the highest sound range and the lowest sound range can be made using a lining piece with the mold for manufacturing the chassis 2, all the chassis required for the keyboard device 1 can be fabricated only with a single mold. It is therefore possible to significantly reduce the manufacturing cost of the chassis, resulting in a significant reduction in manufacturing cost of the keyboard device 1.

Also, if the chassis 2 is adopted as a common standard part, with the keys 3 being made identical in dimensions and shape, among distinct keyboard devices respectively having different numbers of keys, the chassis 2 may be applied not only to the keyboard device 1 of this embodiment but also to other keyboard devices having different numbers of keys, thereby making it possible to further significantly reduce the manufacturing cost of the keyboard devices. In addition, since the chassis 2 can be directly carried on the keybed 5, particular parts which would otherwise be required for assembly can be eliminated, thus resulting in a reduction in the number of parts.

Figure 3:
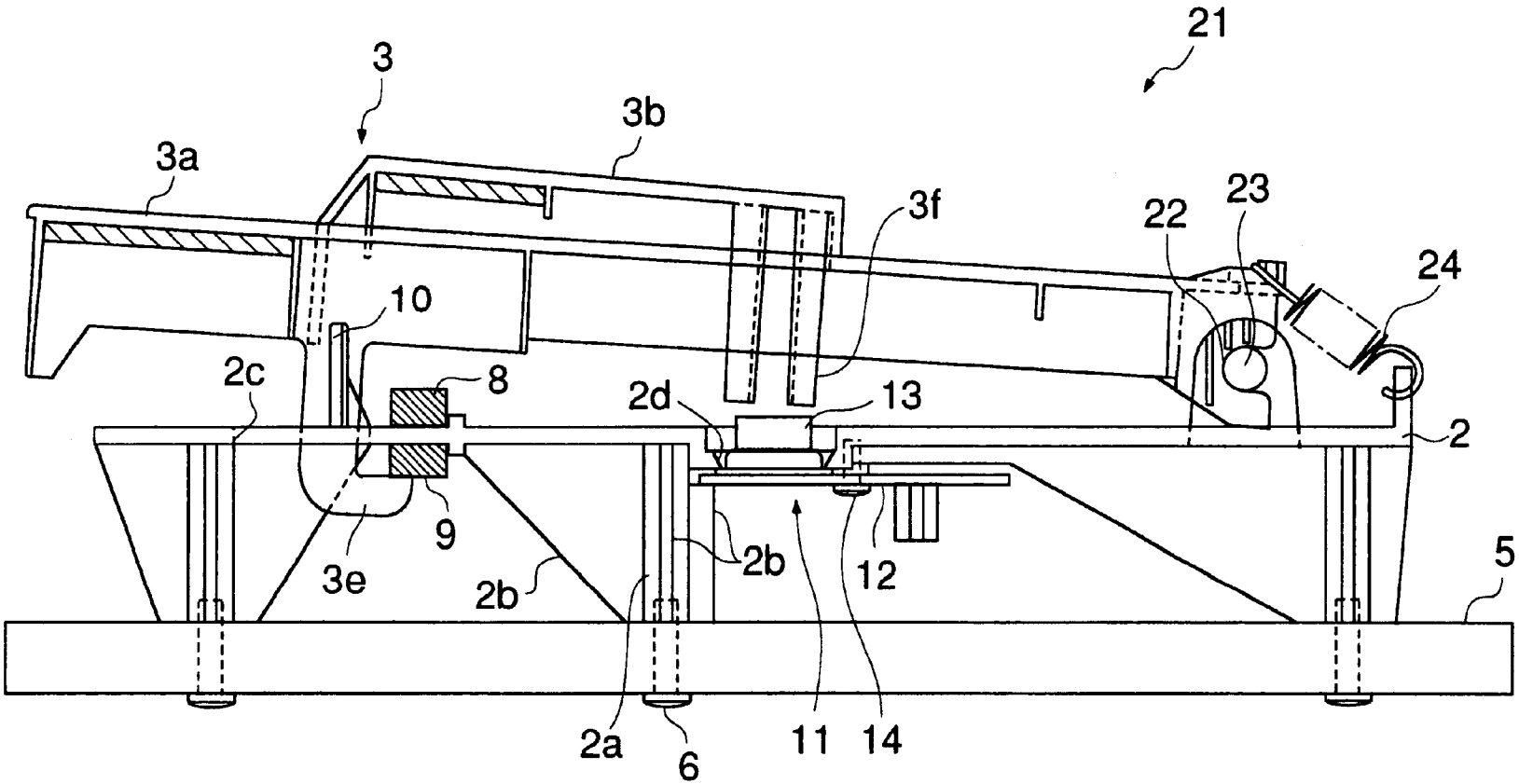
FIG. 3 is a side cross-sectional view of a keyboard device according to a second embodiment.

FIG. 3 illustrates a second embodiment in which the present invention is applied to a second type of keyboard device. It should be noted that in FIG. 2 and figures subsequent thereto, components having similar structures or substantially equivalent functions to those of the keyboard device 1 described previously are designated the same reference numerals, and detailed descriptions thereon will be omitted. As illustrated in FIG. 3, a keyboard device 21 differs from the first type of keyboard device 1 illustrated in FIG. 2 in the cross-sectional shape of the chassis 2 and the structure for supporting the keys 3 on the chassis 2. Specifically, the key 3 is pivotably supported by the chassis 2 with a shaft hole 22 formed in a rear end portion thereof mating with a pin-like key support 23 arranged on the chassis 2. Also, each key 3 is urged at all time by a resilient spring 24 disposed between the chassis 2 and the key 3 toward a key released position.

The rest of the structure of the keyboard device 21 is identical to the keyboard device 1 of the first embodiment illustrated in FIG. 2, so that it is not particularly illustrated. It should be noted however that the overall chassis is partitioned into the seven chassis 2 in octaves which are formed in the same dimensions and shape. The keyboard device 21 of the second embodiment is therefore capable of significantly reducing its manufacturing cost as is the case of the keyboard device 1.

Figure 4:
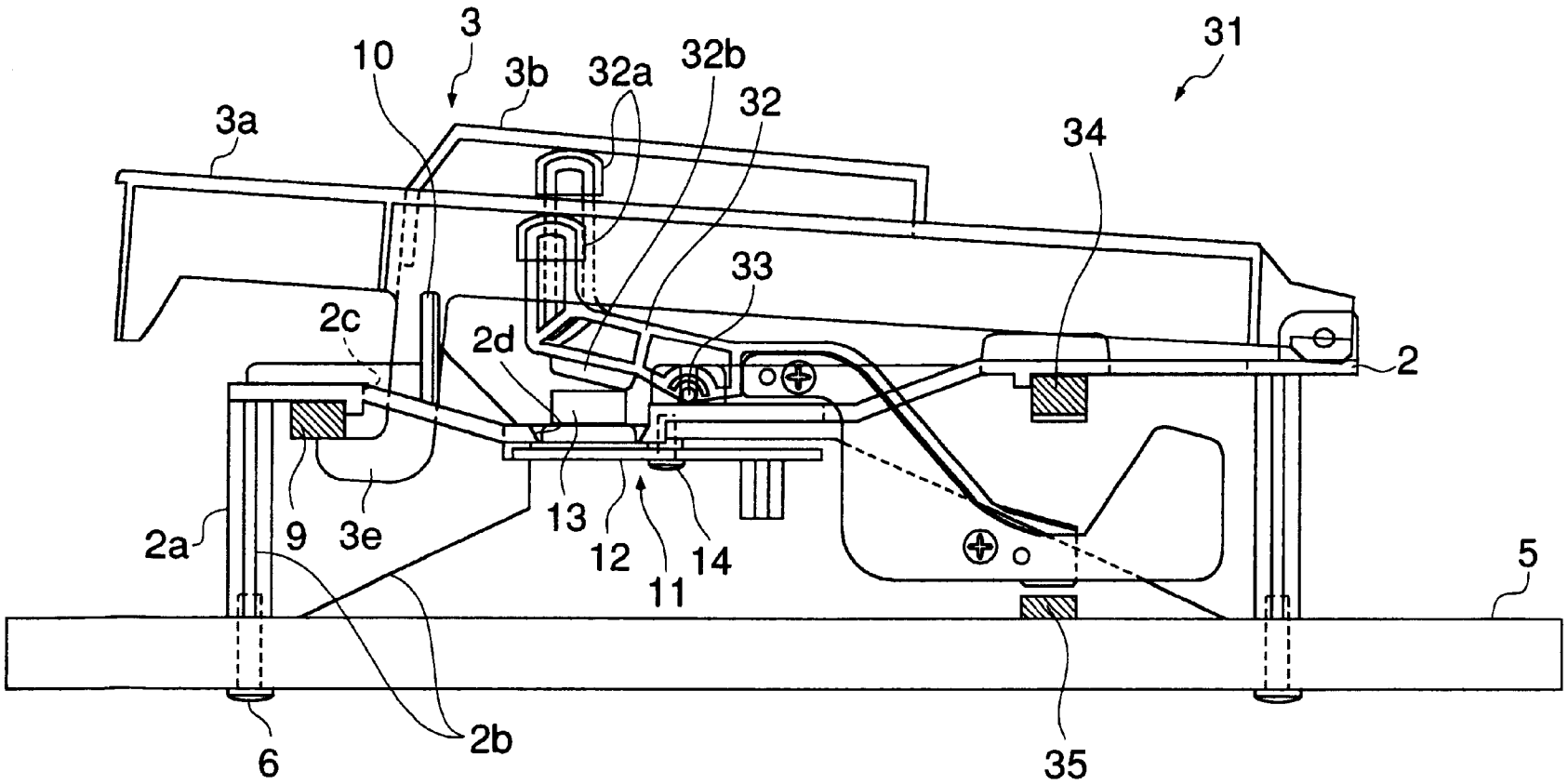
FIG. 4 is a side cross-sectional view of a keyboard device according to a third embodiment.

FIG. 4 illustrates a third embodiment in which the present invention is applied to a third type of keyboard device. As illustrated, a keyboard device 31 largely differs from the aforementioned keyboard devices 1, 21 in the provision of hammers 32 each arranged for pivotal movements to the accompaniment of an operation for pressing an associated key 3, in addition to the difference in the cross-sectional shape of the chassis 2 and the structure for supporting keys 3 on the chassis 2. The hammer 32 is pivotably supported at a hammer fulcrum 33 arranged on the chassis 2 near the center of the hammer 32. Also, the hammer 32 has a key abutting projection 32*a* at the leading end in abutment to the rear surface of a top wall of the key 3, and a portion thereof behind the hammer fulcrum 33 extending downwardly through an opening of the chassis 2. Further, the hammer 32 is formed with an actuator 32*b* below the key abutting projection 32*a*. The actuator 32*b* abuts to a switch body 13 of a key switch 11 from the above.

An upper limit stopper 34 and a lower limit stopper 35 are disposed at respective predetermined position on the bottom of the chassis 2 and on the top of the keybed 5 bottom, respectively, for regulating movements of the hammer 32 between an upper limit and a lower limit. With the structure described above, when a key 3 is pressed, an associated hammer 32 make a pivotal movement in the counter-clockwise direction in FIG. 4 with the key abutting projection 32*a* being pressed by the key 3. During this pivotal movement, the actuator 32*b* presses the switch body 13 of the key switch 11 to detect information indicative of the pressed key 3.

The rest of the structure of the keyboard device 31 is identical to the keyboard devices 1, 21, so that it is not particularly illustrated. It should be noted however that the overall chassis 2 is likewise partitioned into the seven chassis 2 in octaves which are formed in the same dimensions and shape. The keyboard device 31 of the third embodiment is therefore capable of significantly reducing its manufacturing cost as is the case of the keyboard devices 1, 21.

Figure 5:
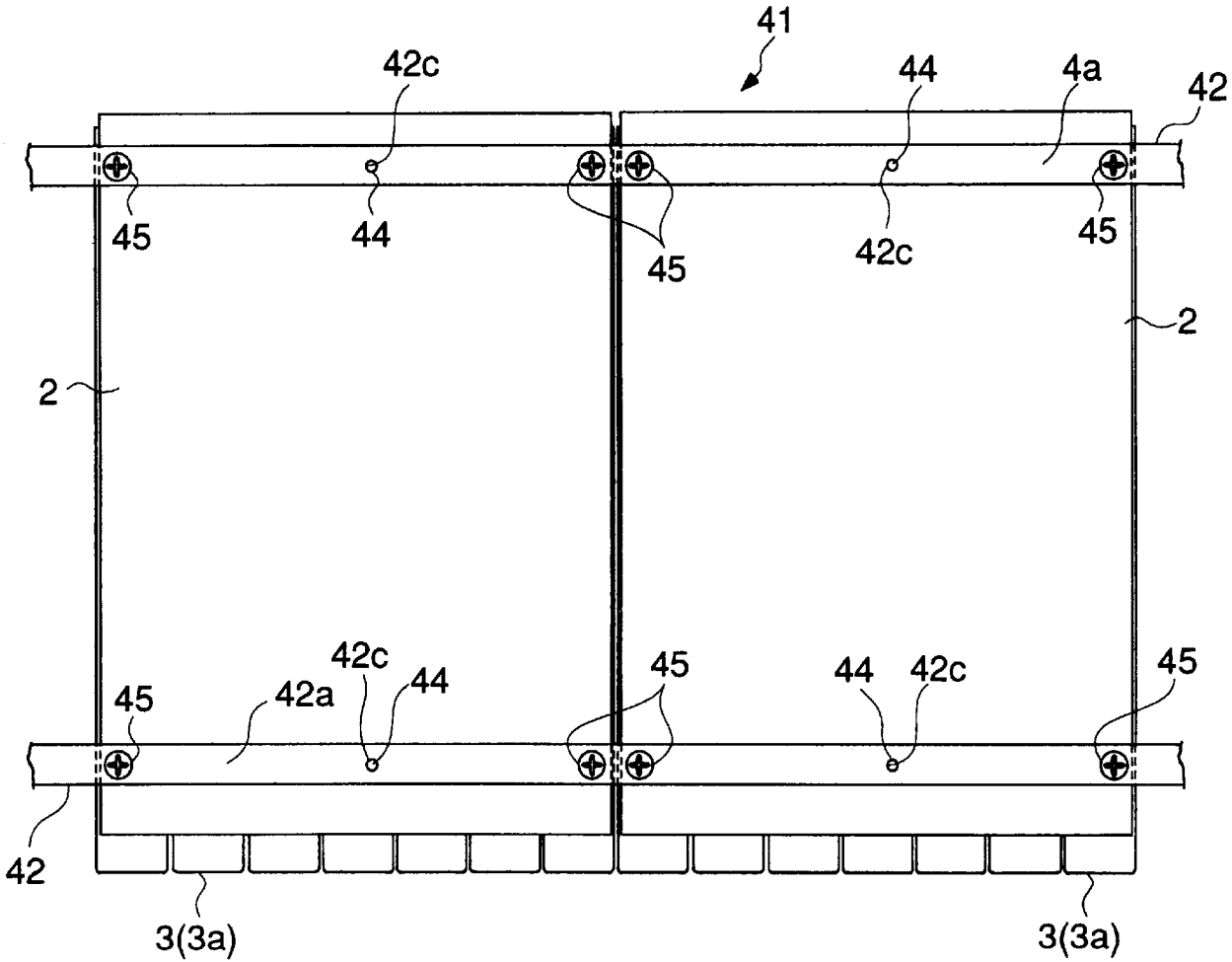
FIG. 5 is a bottom view of a partially omitted keyboard device according to a fourth embodiment.
Figure 6A:
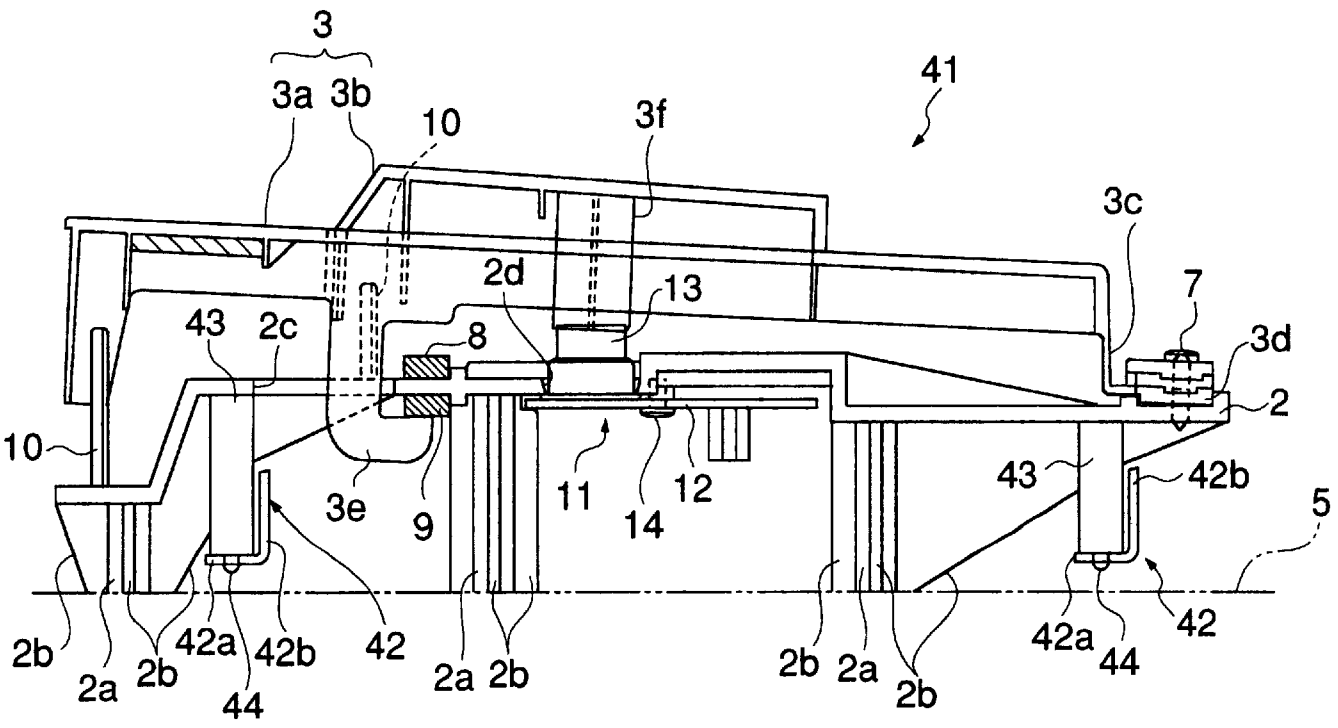
FIG. 6A is a side cross-sectional view of the keyboard device of FIG. 5.
Figure 6B:
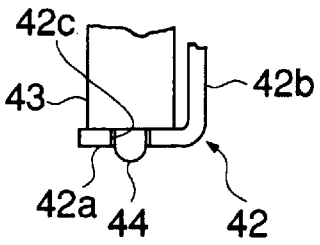
FIG. 6B is a partially enlarged side cross-sectional view of the keyboard device of FIG. 6A.

FIGS. 5 to 6B illustrates a keyboard device according to a fourth embodiment of the present invention. The illustrated keyboard device 41 has seven chassis 2 and the sub-chassis for the lowest sound range and the highest sound range of the first type of the keyboard device 1 in FIG. 2, coupled with one another by front and rear coupling members 42. Each coupling member 42 extends over the entire lengths of the chassis 2 and the sub-chassis in the left-to-right direction, and is of a continuously elongated angle type, formed, for example, of an extrusion molding of aluminum alloy. The coupling member 42 is formed in an inverted L-shape in cross-section, composed of a horizontal attaching portion 42*a* and a reinforcement 42*b* extending upwardly from the rear edge of the attaching portion 42*a*.

The attaching portion 42*a* of each coupling member 42 is formed with nine positioning holes 42*c* (positioning members) at predetermined positions (only two of which are shown for each in FIG. 5). On the other hand, as illustrated in FIGS. 6A and 6B, each of the chassis 2 is formed in a front end portion and a rear end portion of the bottom thereof with coupling bosses 43 (only one of which is shown), projecting downwardly, in a central portion and left and right end portions. The central coupling boss 43 is provided with a salient 44 (for engagement). Then, each chassis 2 is attached to the coupling member 42 with the salient 44 engaging with the positioning hole 42*c*, thereby allowing the chassis 2 to be mutually aligned in a predetermined positional relationship through the coupling members 42. Each of the chassis 2, in such an aligned state, is also secured to the coupling members 42 by screwing screws 45 into its left and right coupling bosses 43 from below (see FIG. 5). Though not shown, the sub-chassis are also coupled to the coupling members 42 in a similar structure to the above.

According to the keyboard device 41 of the third embodiment as described above, sine the plurality of chassis 2 are coupled to each other with the coupling member 42, the degree of freedom in assembling the keyboard device 41 can be increased, for example, keys 3 can be attached to the plurality of chassis 2 coupled with the coupling means 42 before the chassis 2 are carried on a keybed 5. Then, the assembling of the keyboard device 41 in this way before carried on the keybed 5 can facilitate works involved in the assembling of the keyboard device 41, mutual positioning of keys 3 attached on the chassis 2, and so on. It is therefore possible to avoid possible damages on the surfaces of the keys 3 which are highly likely to occur when the chassis 2, the keys 3 and so on are sequentially assembled on the keybed 5.

Also, when the chassis 2 are coupled with the coupling members 42, the salients 44 are engaged with the associated positioning holes 42*c* of the coupling members 42 to allow for highly accurate and easy mutual positioning of the plurality of chassis 2 through the coupling members 42. This further facilitates works associated with the assembly of the chassis 2. Further, since the coupling members 42 include the reinforcements 42*b* extending in the vertical direction, the rigidity of the assembled chassis 2 can be enhanced against a load from the above, thereby making it possible to suppress deflection of the chassis 2 in the left-to-right direction. In this way, since the coupling members 42 can be utilized also as reinforcing members for the chassis 2, this leads to elimination of additional reinforcing members, and ribs integrally formed with the chassis 2, for adding the rigidity of the chassis 2. As a result, a reduction in the number of parts and a simplification of a mold in shape can be achieved, thereby reducing the manufacturing cost.

Figure 7:
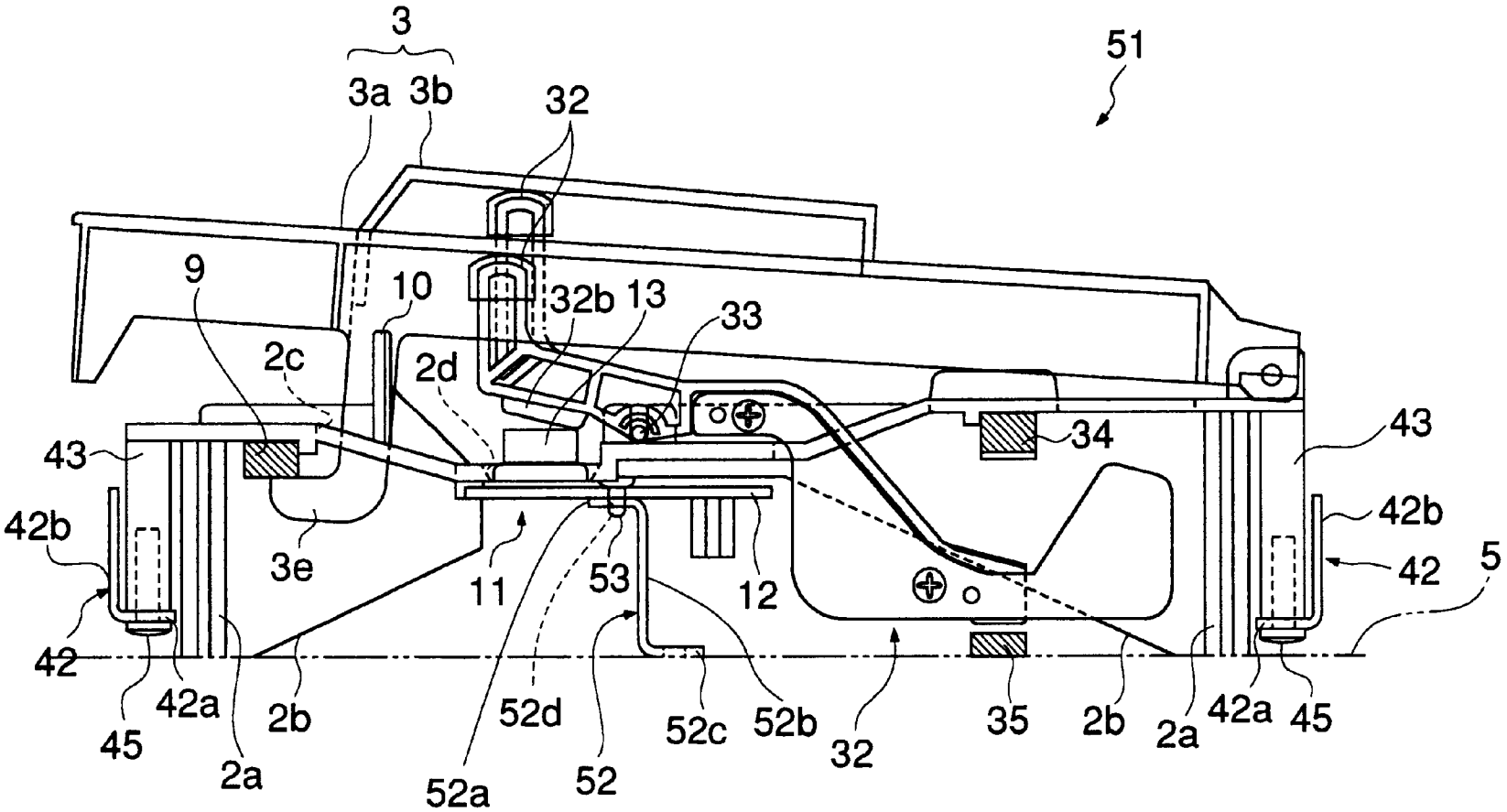
FIG. 7 is a partially omitted bottom view of a keyboard device according to a fifth embodiment.

FIG. 7 illustrates a keyboard device according to a fifth embodiment of the present invention. The illustrated keyboard device 51 differs from the keyboard device 31 of the third type illustrated in FIG. 4 in that a plurality of chassis 2 and sub-chassis are coupled with a central coupling member 52 as well as front and rear coupling members 42, and the front and rear coupling members 42 do not have positioning holes for positioning the chassis 2. The front and end coupling members 42 are substantially similar in structure to those employed in the aforementioned fourth embodiment, and are secured to coupling bosses 43 formed in front and rear portions of the respective chassis 2 with screws.

The central coupling member 52 continuously extends over the entire lengths of the chassis 2 and the sub-chassis in the left-to-right direction. The central coupling member 52 is composed of an upper horizontal attaching portion 52*a*, a reinforcement 52*b* extending downwardly from the rear edge of the upper attaching portion 52*a*, and a lower horizontal attaching portion 52*c* extending rearwardly from the lower edge of the reinforcement 52*b*. The upper attaching portion 52*a* are formed with nine positioning holes 52*d* (only one of which is shown) at predetermined positions. Each of the chassis 2, on the other hand, is formed with a salient 53 in a central portion of the bottom, such that each of the chassis 2 is attached to the central coupling member 52 with the salient 53 extending through a printed circuit board 12 of a key switch 11 and engaging with the positioning hole 52*d* of the central coupling member 52. In this way, the chassis 2 are mutually aligned through the central coupling member 52. Each of the chassis 2, in such an aligned state, is secured to the upper attaching portion 52*a* of the central coupling member 52 together with the printed circuit board 12 with screws (not shown), and is also secured to a keybed 5 through the lower attaching portion 52*c* with screws.

According to the keyboard device 51 of the fifth embodiment as described above, the plurality of chassis 2 are coupled with the coupling members 42, 52, and the chassis 2 are mutually aligned through engagement of their salients 53 with the positioning holes 52*d* of the central coupling member 52, so that the advantages provided by the fourth embodiment can be achieved in a similar manner. In addition, since in the fifth embodiment, the central coupling member 52 includes the reinforcement 52*b* extending in the vertical direction, and the chassis 2 are secured to the central coupling member 52 together with the printed circuit board 12, a load acting on the printed circuit board 12 can be effectively supported by the central coupling member 52 and the keybed 5 to which the central coupling member 52 is secured. This can prevent the printed circuit board 12 substantially from deflection. As a result, it is possible to obviate troubles such as malfunctions due to disconnection, short-circuiting, and so on caused by deflection, deformation or the like of the printed circuit board 12, thereby improving the durability of the overall keyboard device.

Similarly, since the coupling members 52 are disposed near hammer fulcrums 33 on the chassis 2, a load acting on a hammer fulcrum 33 and its surroundings from the above, due to a key pressing operation or the like, can be effectively supported by the coupling members 52 and the keybed 5. This can prevent deflection and deformation of the chassis 2 near the hammer fulcrum 33, thereby making it possible to stably and smoothly handle a key pressing operation while preventing variations in pivoting stroke of a hammer 32, shaking of the hammer 32, and so on.

Figure 8:
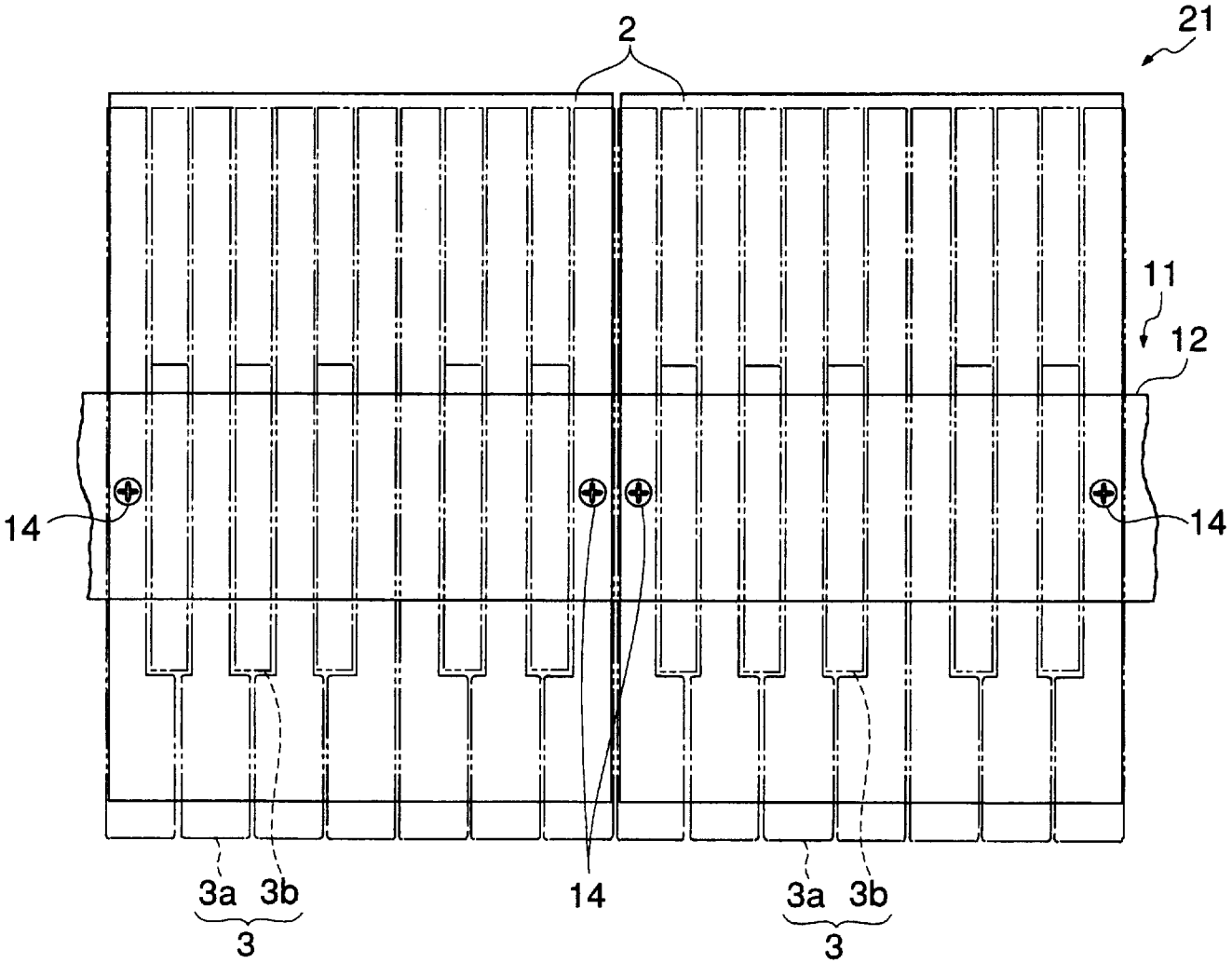
FIG. 8 is a partially omitted bottom view illustrating an exemplary modification to the keyboard device of FIG. 3.

FIG. 8 illustrates an modified example to the second type of keyboard device 21 previously illustrated in FIG. 3. The illustrated example utilizes the printed circuit board 12 of the key switch 11 to couple the plurality of chassis 2 and the sub-chassis, without using separate coupling members. Specifically, as illustrated in FIG. 8, the printed circuit board 12 continuously extends over the entire lengths of the chassis 2 and the sub-chassis in the left-to-right direction, and secured to the bottom of the respective chassis 2 with screws 14. In this way, the chassis 2 and the sub-chassis are coupled together to the printed circuit board 12, and simultaneously, a key switch 11 is attached to the chassis 2.

As described above, since the plurality of chassis 2 are mutually coupled utilizing the printed circuit board 12 associated with the key switch 11 generally provided in an electronic piano, separate coupling members for coupling the chassis 2 are eliminated to correspondingly reduce the number of parts, thereby making it possible to further reduce the manufacturing cost. In addition, such coupling of chassis 2 with the printed circuit board 12 means that the key switch 11 is simultaneously attached to the chassis 2. In other words, the coupling of the chassis 2 can be carried out simultaneously with the attaching portion of the key switch 11, so that the simplification can be further promoted in assembling the keyboard device 21.

Figure 9:
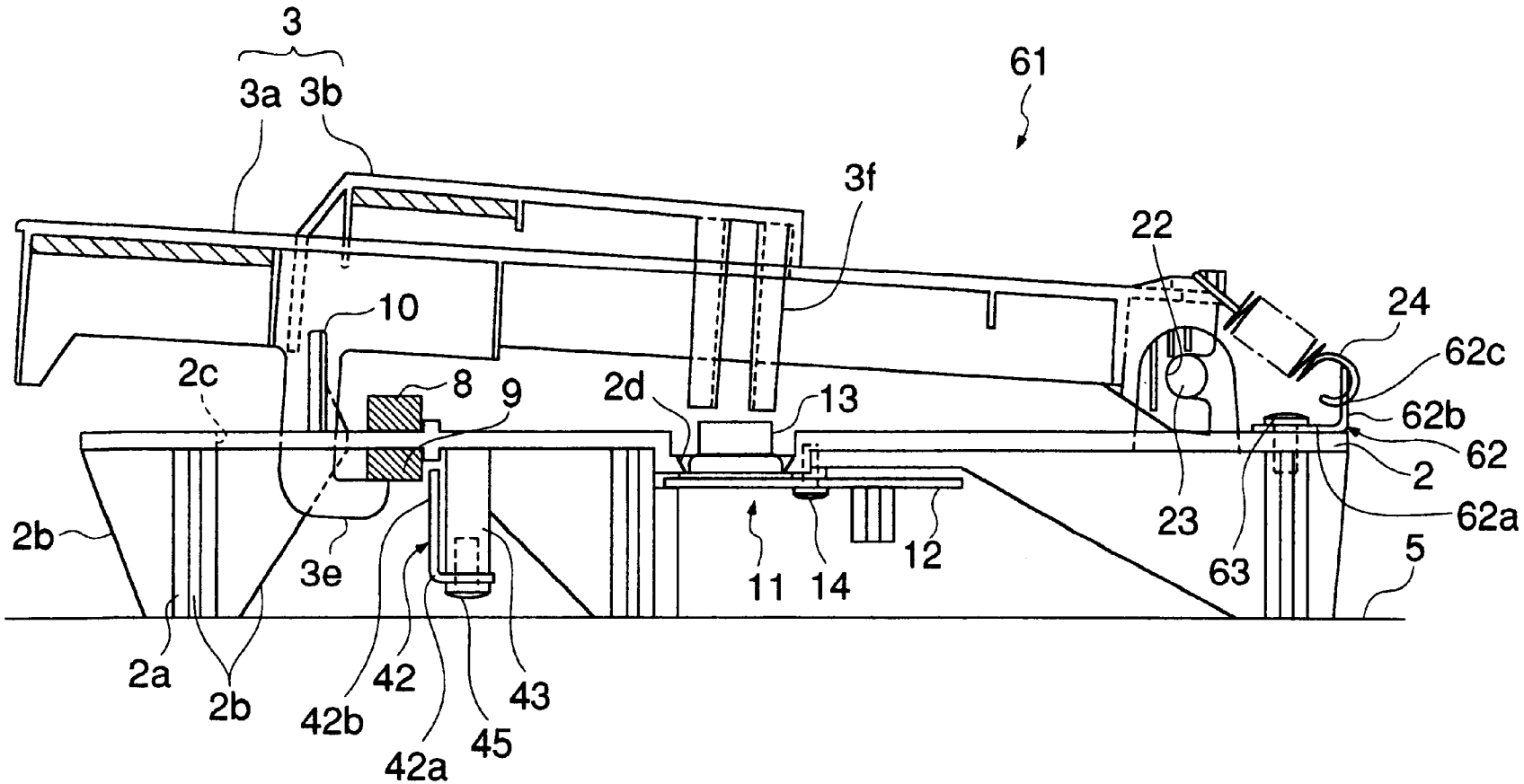
FIG. 9 is a side cross-sectional view of a keyboard device according to a sixth embodiment.

FIG. 9 illustrates a keyboard device according to a sixth embodiment of the present invention. The illustrated keyboard device 61 couples a plurality of chassis 2 and sub-chassis such as those utilized in the second type of keyboard device 21 previously illustrated in FIG. 3 with a front coupling member 42 and a rear coupling member 62, wherein the rear coupling member 62 also serves as a retaining member for a resilient spring 24. The front coupling member 42 is constructed in a similar manner to the front coupling member 42 according to the aforementioned fifth embodiment, and specifically is formed in an inverted L-shape in cross-section and secured to the chassis 2 with screws 45.

The rear coupling member 62 in turn extends continuously over the entire lengths of the chassis 2 and the sub-chassis in the left-to-right direction, like the front coupling member 42, and is formed in an inverted L-shape in cross-section, composed of a horizontal attaching portion 62*a* and a spring retainer 62*b* extending upwardly from the rear edge of the attaching portion 62*a*. The spring retainer 62*b* is formed with a plurality of engaging holes 62*c* (only one of which is shown) corresponding to respective keys 3. Then, the rear coupling member 62 is secured with screws 63 to the top of a rear end portion of the respective chassis 2 in a portion of the attaching portion 62*a*, and the resilient spring 24 has both ends hooked at an engaging hole 62*c* of the spring retainer 62*b* and the rear end of the key 3, so that the spring 24 is retained therebetween.

As described above, in the sixth embodiment, since the resilient spring 24 for returning the key 3 to a key released position is retained by the rear coupling member 62, a spring retaining member, which has been conventionally required for this purpose, can be eliminated to correspondingly reduce the number of parts, thereby further reducing the manufacturing cost.

Figure 10:
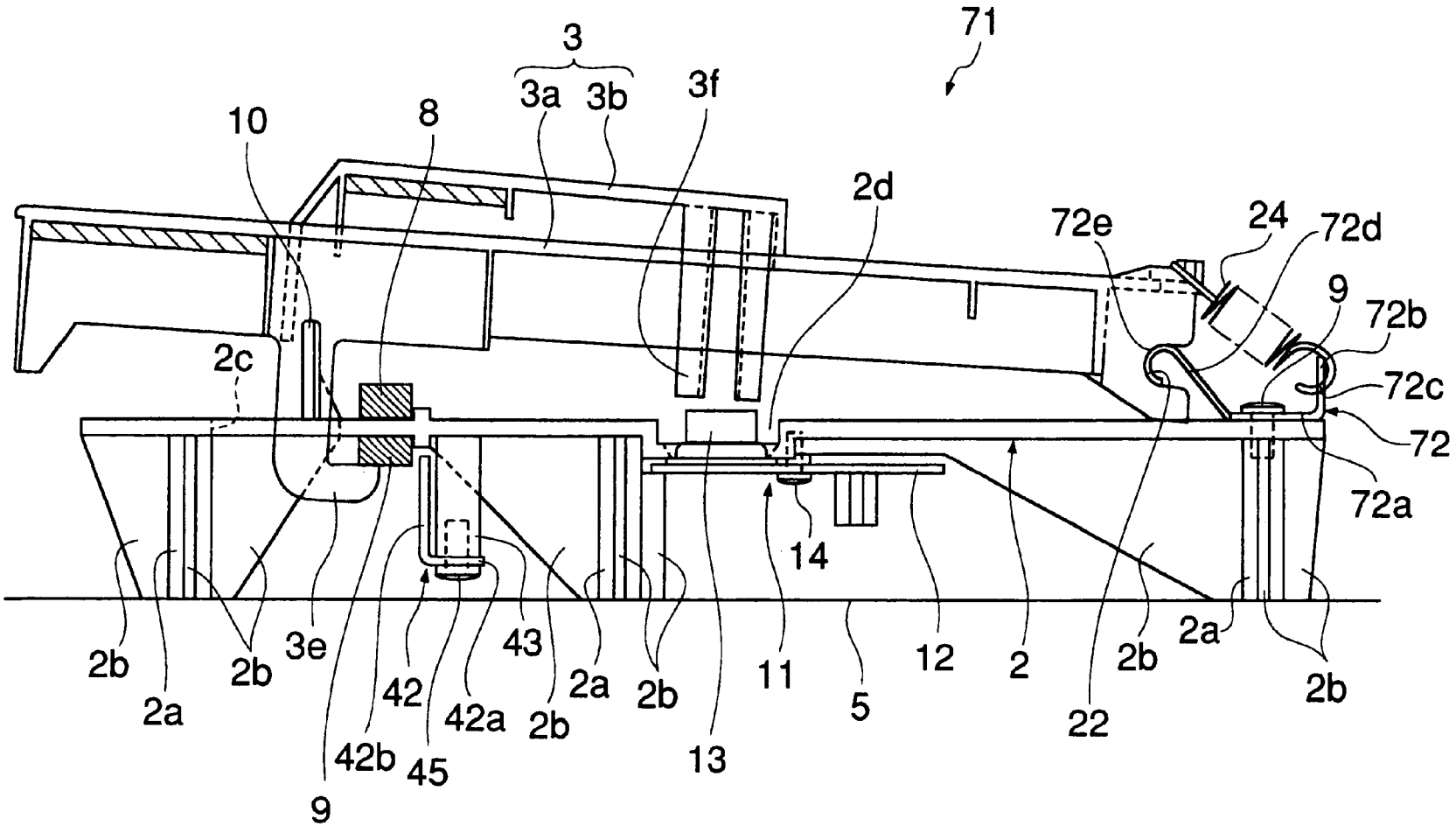
FIG. 10 is a side cross-sectional view of a keyboard device according to a seventh embodiment.

FIG. 10 illustrates a keyboard device according to a seventh embodiment of the present invention. The illustrated keyboard 71 has a rear coupling member 72 of a different structure, in place of the rear coupling member 62 of the keyboard device 61 according to the aforementioned sixth embodiment. The rear coupling member 72 is utilized not only as a retaining member for a resilient spring 24 but also as a supporting member for keys 3. This rear coupling member 72 likewise extends continuously over the entire lengths of chassis 2 and sub-chassis in the left-to-right direction. Also, as illustrated in FIG. 10, the rear coupling member 72 is composed of a horizontal attaching portion 72*a*; a spring retainer 72*b* extending vertically upwardly from the rear edge of the attaching portion 72*a*, and having a plurality of engaging holes 72*c* (only one of which is shown) formed therethrough; and a key supporting member 72*d* extending angularly from the front end of the attaching portion 72*a* toward the upper front. A leading end portion of the key supporting member 72*d* is curved in an R-shape to form a key fulcrum 72*e*.

The rear coupling member 72 having the foregoing structure is secured to a rear end portion of the top of each chassis 2, in a manner similar to the rear coupling member 62 of the sixth embodiment. Then, each key 3 is pivotably supported by the rear coupling member 72 with its shaft hole 22 engaging with the key fulcrum 72*e* of the rear coupling member 72. In addition, the resilient spring 24 has both ends hooked at the key 3 thus attached and an engaging hole 72*c* of the rear coupling member 72, so that the spring 24 is retained therebetween.

As described above, in the seventh embodiment, the rear coupling member 72 retains the resilient springs 24 as well as supports the keys 3. Therefore, in addition to the advantage offered by the aforementioned sixth embodiment, the keys 3 are directly supported by the rear coupling member 72, so that key supporting members, which have conventionally been provided for this purpose, can be eliminated to correspondingly reduce the number of parts, thereby further reducing the manufacturing cost. Also, since the rear coupling member 72 is configured as a single coupling member extending over all the keys 3, the positions of the key fulcrums 72*e* for the respective keys 3 are uniformly defined over the entire keyboard device 71 without being affected by an assembly accuracy of the plurality of chassis 2. This results in significantly small variations in the height, mutual intervals, stroke and so on of the keys 3, thereby making it possible to extremely readily adjust these items.

Figure 11:
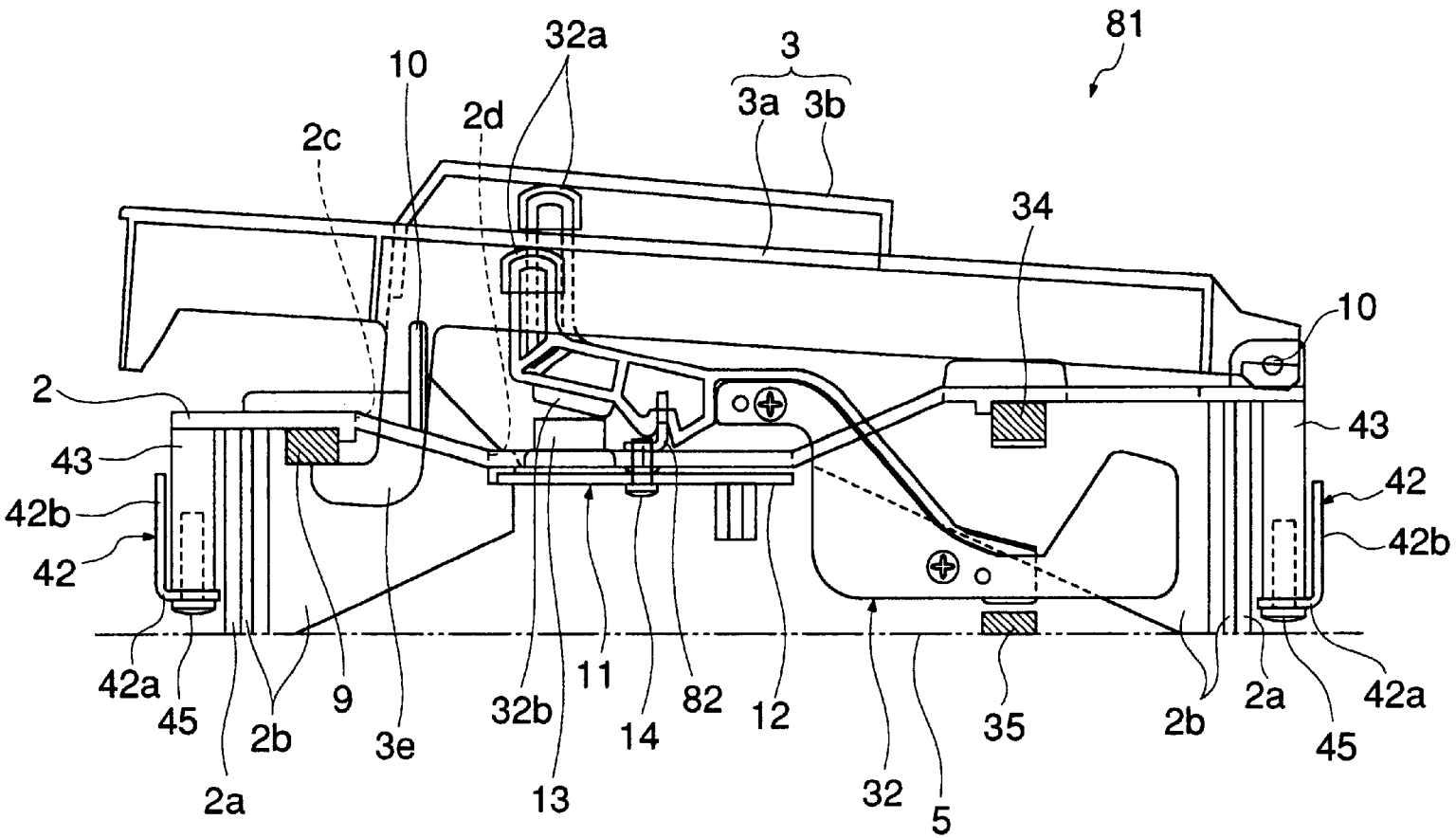
FIG. 11 is a side cross-sectional view of a keyboard device according to an eighth embodiment.
Figure 12A:
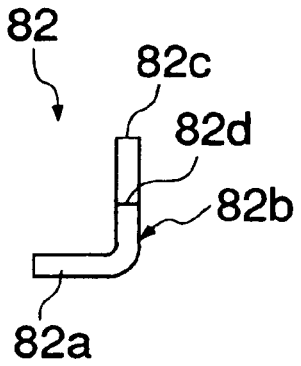
FIG. 12A is a side cross-sectional view of an intermediate coupling member in the keyboard device of FIG. 11.
Figure 12B:
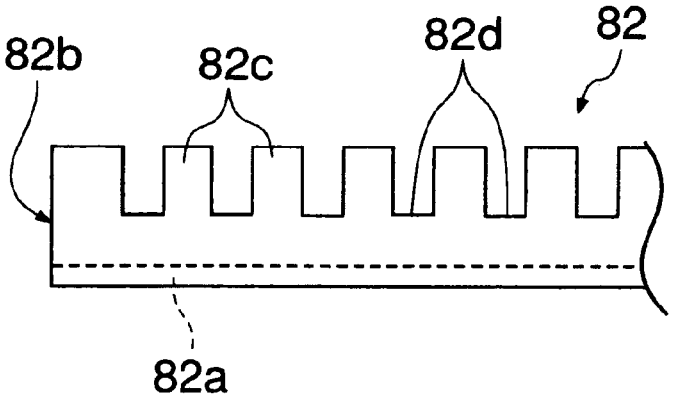
FIG. 12B is a back view of the intermediate coupling member of FIG. 12A.

FIGS. 11 to 12B illustrate a keyboard device according to an eighth embodiment of the present invention. The illustrated keyboard device 81 has an intermediate coupling member 82 of a different structure in place of the intermediate coupling member 52 of the keyboard device 51 according to the aforementioned fifth embodiment, and utilizes the intermediate coupling member 82 as a hammer support for hammers 32. The intermediate coupling member 82 likewise extends continuously over the entire lengths of chassis 2 and sub-chassis in the left-to-right direction. As illustrated in FIG. 12A, the intermediate coupling member 82 is formed in an inverse L-shape in cross-section, composed of a horizontal attaching portion 82*a* and a hammer support 82*b* extending vertically upwardly from the rear edge of the attaching portion 82*a*. Also, as illustrated in FIG. 11, the intermediate coupling member 82 is secured with screws 14 from the below to a central portion of each chassis 2 in a portion of the attaching portion 82*a* together with a printed circuit board 12 of a key switch 11. Further, as illustrated in FIG. 12B, the hammer support 82*b* of the intermediate coupling member 82 is formed with a plurality of alternating engaging protrusions 82*c* and engaging recesses 82*d* along its lengthwise direction at the same height, in the same depth, at equal intervals, and in a comb shape. Then, as illustrated in FIG. 11, a hammer 32 is engaged in and supported by associated engaging protrusion 82*c* and engaging recess 82*d*.

As described above, in the eighth embodiment, since the hammers 32 are directly supported by the intermediate coupling member 82, hammer supporting members, which have been conventionally required for this purpose, can be eliminated to correspondingly reduce the number of parts, thereby further reducing the manufacturing cost. Also, since the intermediate coupling member 82 is configured as a single coupling member extending over all the hammers 32, the hammers 32 are uniformly supported in terms of position over the entire keyboard device 81, without being affected by an assembling accuracy of the plurality of chassis 2. This results in significantly small variations in the height, mutual intervals, stroke and so on of the hammers 32, thereby making it possible to extremely readily adjust these items.

Further, since the hammers 32 are engaged in and supported by a plurality of alternating engaging protrusions 82*c* and engaging recesses 82*d* formed in a comb shape in the intermediate coupling member 82, the plurality of hammers 32 can be supported at uniform supporting positions with such a relatively simple and inexpensive structure. Furthermore, since the intermediate coupling member 82 formed in an L-shape in cross-section has a relatively high rigidity, a reinforcing function of the chassis 2 can also be enhanced.

Figure 13:
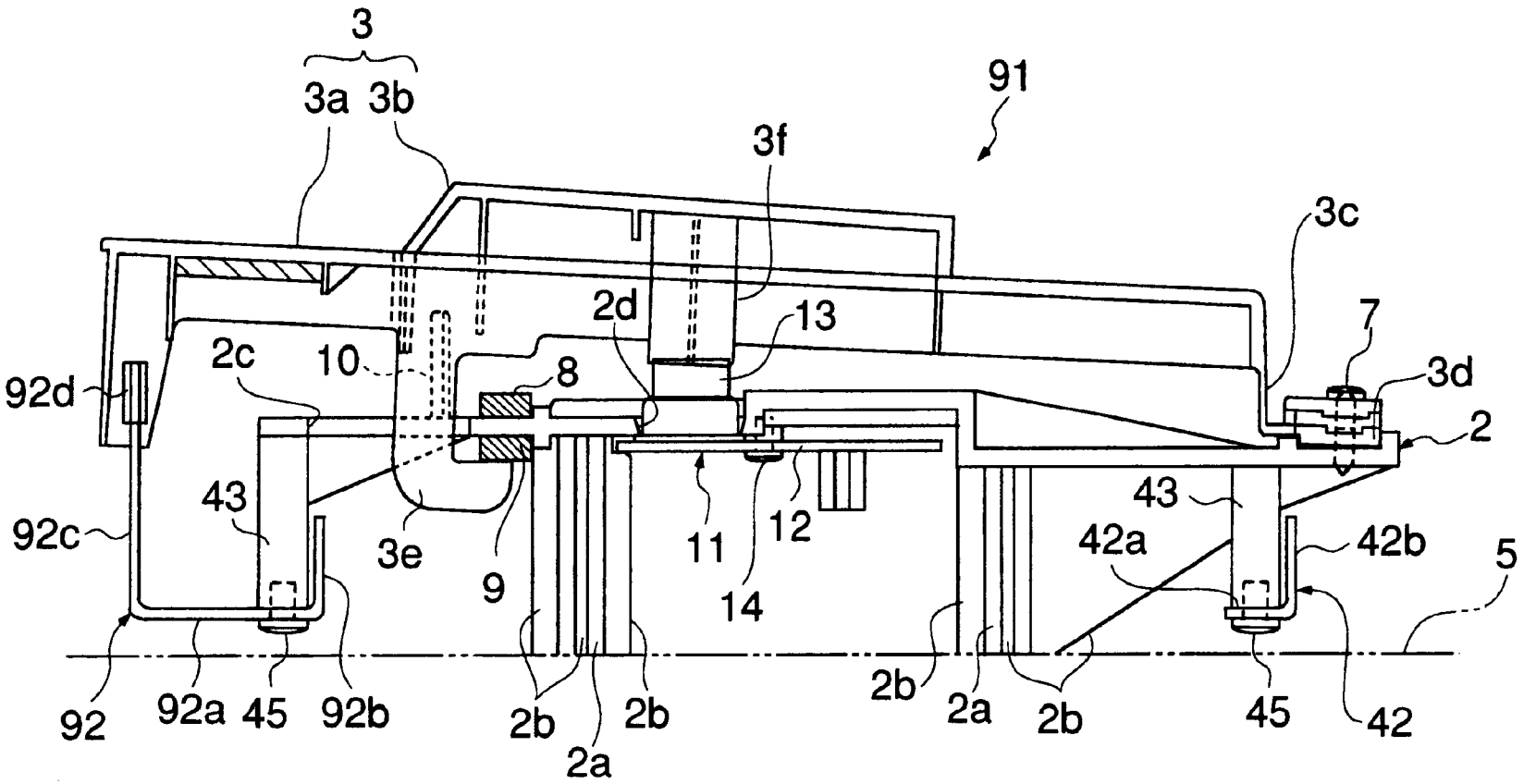
FIG. 13 is a side cross-sectional view of a keyboard device according to a ninth embodiment.

FIG. 13 illustrates a keyboard device according to a ninth embodiment of the present invention. The illustrated keyboard device 91 has a front coupling member 92 of a different structure in place of the front coupling member 42 of the keyboard device 41 according to the aforementioned fourth embodiment. This front coupling member 92 is utilized as a key guide for guiding pivotal movements of keys 3. The front coupling member 92 likewise extends continuously over the entire lengths of chassis 2 and sub-chassis in the left-to-right direction. Also, as illustrated in FIG. 13, the front coupling member 92 is formed substantially in a U-shape in cross-section, composed of a horizontal attaching portion 92*a*; a key guide 92*c* extending vertically upwardly from the front end of the attaching portion 92*a*; and an upright portion 92*b* extending vertically upwardly from the rear end of the attaching portion 92*a*. The key guide 92*c* has a plurality of engaging portions (not shown) in a comb shape for engagement with respective white keys 3*a* at predetermined positions. A rubber bush 92*d* is attached to an upper end of each engaging portion. With this structure, the key guide 92 guides a white key 3, when it is pressed, to rotate so as to prevent the same from shaking in the left-to-right direction.

As described above, in the ninth embodiment, the key guide 92*c* for guiding pivotal movements of the keys 3, provided in the front coupling member 92, eliminates the need for adjustments to a mold for the chassis which have conventionally been performed for making uniform the positions of key guides. Also, since the rear coupling member 92 is configured as a single coupling member extending over all the keys 3, all the key guides 92*c* can be set at appropriately defined intervals therebetween only by coupling a plurality of chassis 2 by the front coupling member 92, irrespective of an assembling accuracy of the chassis 2. Unlike the prior art, since this eliminates the need for positional adjustments to the key guides after the chassis 2 have been coupled, the assembly of the keyboard device 91 is further facilitated.

Figure 14:
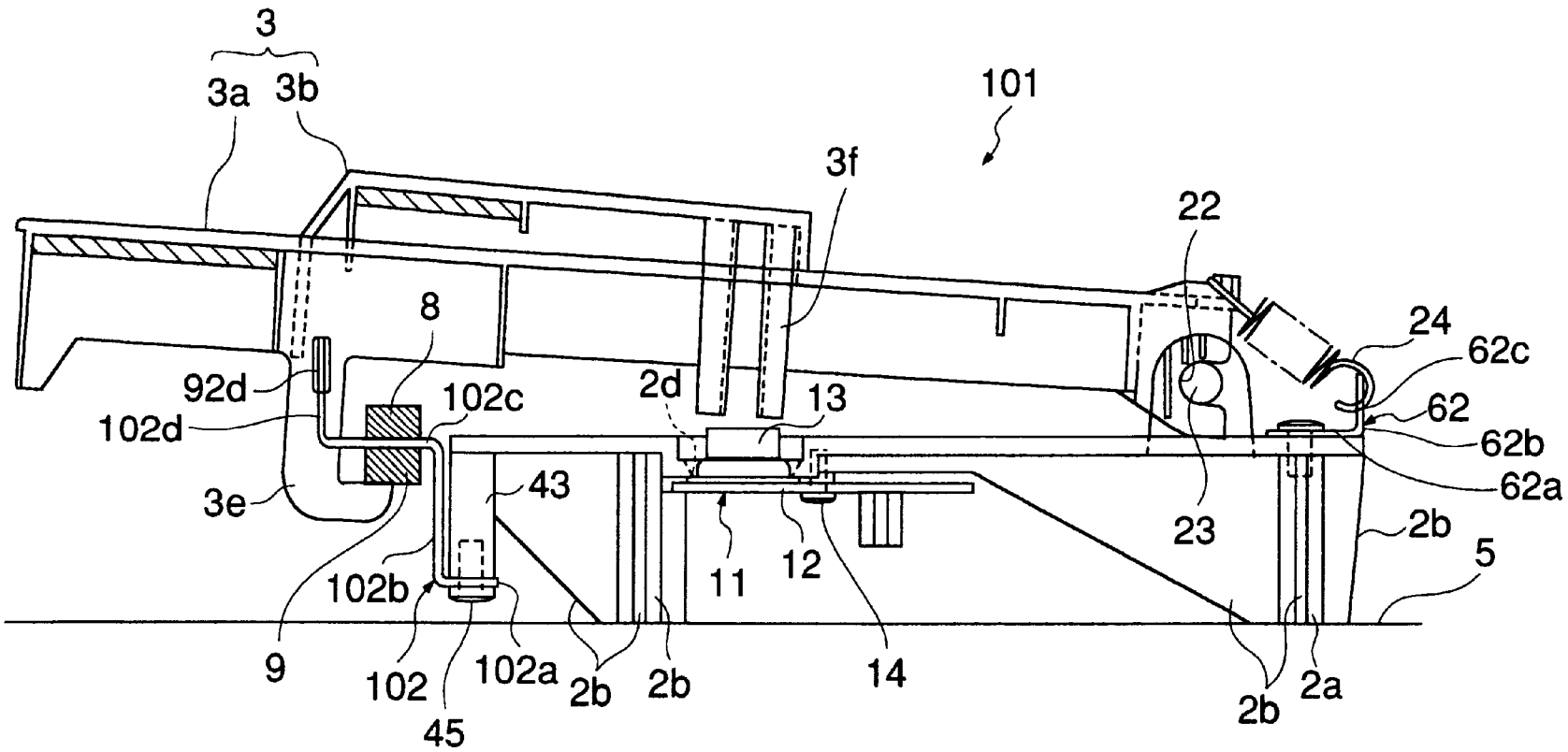
FIG. 14 is a side cross-sectional view of a keyboard device according to a tenth embodiment.

FIG. 14 illustrates a keyboard device according to a tenth embodiment of the present invention. The illustrated keyboard device 101 has a front coupling member 102 of a different structure, in place of the front coupling member 42 of the keyboard device 61 according to the aforementioned sixth embodiment. The front coupling member 102 is provided with a key guide as well as a lower limit stopper 8 and an upper limit stopper 9 for regulating the range of pivotal movements of a key 3. The front coupling member 102 likewise extends continuously over the entire lengths of chassis 2 and sub-chassis in the left-to-right direction.

Also, a s illustrated i n FIG. 14, the front coupling member 102 is formed in a step shape in cross-section, composed of a horizontal attaching portion 102*a*; an upright portion 102*b* extending upwardly from the front end of the attaching portion 102*a*; a stopper mount 102*c* extending forwardly from the upper end of the upright portion 102*b*; and a key guide 102*d* extending forwardly from the front end of the stopper mount 102*c*. The key guide 102*d* has a plurality of engaging portions (not shown) for engaging with respective keys 3 at predetermined positions, in a manner similar to the aforementioned ninth embodiment. In addition, a bush 92*d* is attached to an upper end of each engaging portion. Further, a lower limit stopper 8 and an upper limit stopper 9, both made of rubber, are attached to the top and bottom of the stopper mount 102*c*, respectively.

As described above, in the tenth embodiment, since the front coupling member 102 is provided with the key guide 92*c*, the advantage provided by the aforementioned ninth embodiment can be achieved in a similar manner. In addition, since the lower limit stopper 8 and the upper limit stopper 9 for regulating the range of pivotal movements of an associated key 3 are also attached to the front coupling member 102, all the keys 3 can be pivoted over a uniform range regulated by the upper and lower stoppers 8, 9 only by coupling the plurality of chassis 2 by the front coupling member 102. Unlike the prior art, this eliminates the need for adjustments to the upper and lower stoppers 8, 9 for making uniform the strokes of pivotal movements of all the keys 3, after the chassis 2 have been coupled, so that the keyboard device 101 can be assembled more easily.

Figure 15:
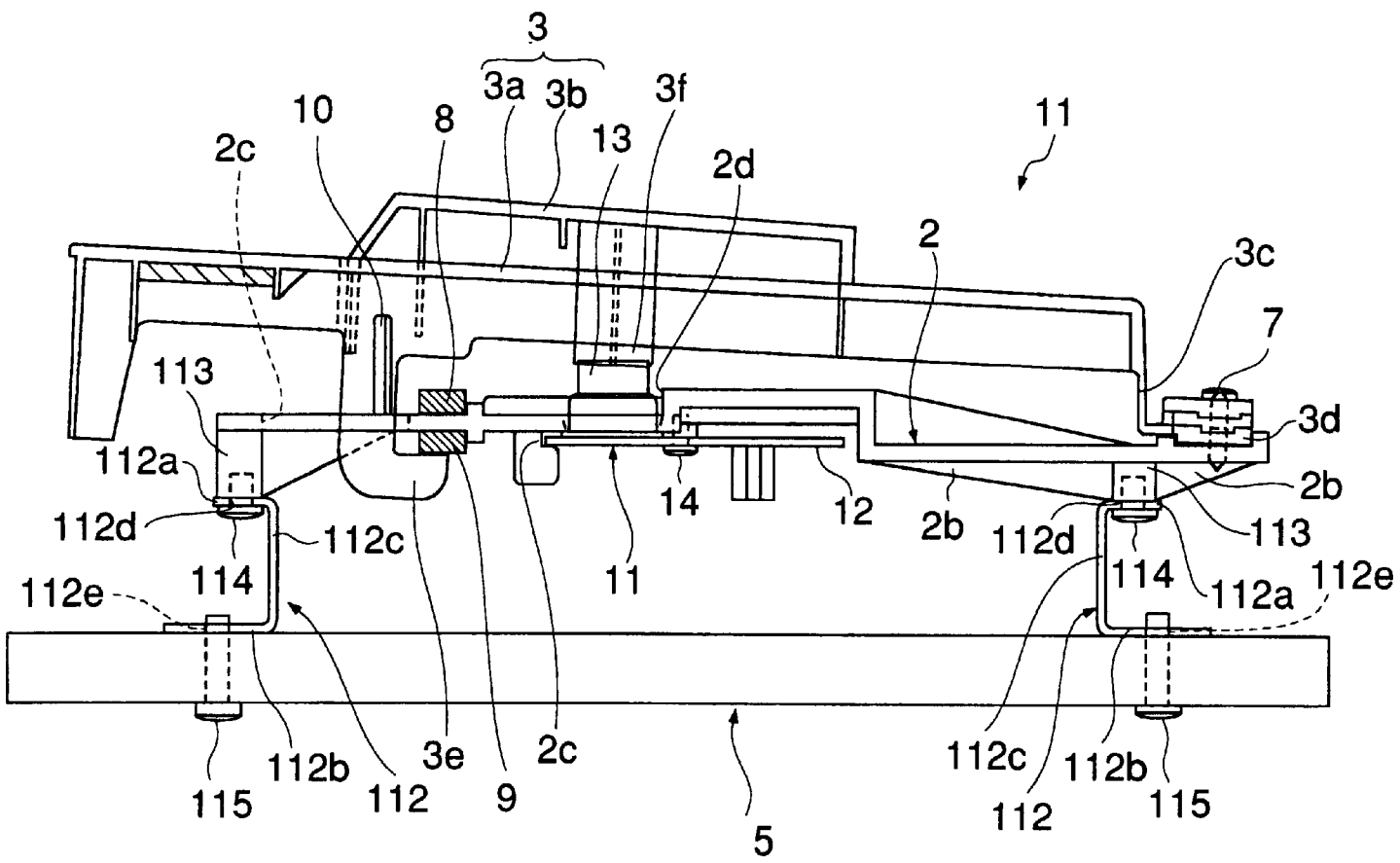
FIG. 15 is a side cross-sectional view of a keyboard device according to an eleventh embodiment.

FIG. 15 illustrates a keyboard device according to an eleventh embodiment of the present invention. The illustrated keyboard device 111 has front and rear coupling members 112 of different structures in place of the front and rear coupling members 42 of the keyboard device 41 according to the foregoing fourth embodiment. Chassis 2 are secured to a keybed 5 only through these coupling members 112. Each of the coupling members 112 is a single body made of metal which extends continuously over the entire lengths of the chassis 2 and sub-chassis in the left-to-right direction. For example, the coupling members 112 may be formed of extrusion moldings made of aluminum alloy.

Also, as illustrated in FIG. 15, the front coupling member 112 is composed of an upper horizontal chassis coupling portion 112*a*; a lower horizontal keybed securing portion 112*b*; and a upright portion 112*c* connecting the rear edges of the two horizontal portions. The chassis coupling portion 112*a* is formed with a plurality of bolt holes 112*d* (only one of which is shown) at positions corresponding to a plurality of short bosses 113 (only one of which is shown) projecting downwardly from a front end portion of the chassis 2. The keybed securing portion 112*b* is formed with a plurality of screw holes 112*e* (only one of which is shown). Then, the front coupling member 112 couples chassis 2 by screwing screws 114 into corresponding bosses 113 through the bolt holes 112*d* of the chassis coupling portion 112*a* from below. The chassis 2 are secured to the keybed 5 by screwing screws 115 through the keybed 5 into corresponding screw holes 112*e* of the keybed securing portion 112*b* from below.

The rear coupling member 112 in turn is formed symmetrically with the front coupling member 112 in the front-to-rear direction, and couples the chassis 2 and is secured to the keybed 5 in a similar manner to the front coupling member 112.

As described above, in the eleventh embodiment, the chassis 2 are secured to the keybed 5 with the screws 115 which are screwed into the front and rear metal coupling members 112 from the keybed 5 side, so that a sufficient holding force imparted by screws, enables the keyboard device 111 to be firmly secured to the keybed 5 while preventing troubles such as shaky screws or the like. Also, this structure eliminates separate attaching members, which have conventionally been required for this purpose, to correspondingly reduce the number of parts and the number of assembling steps, thereby making it possible to further reduce the manufacturing cost.

Figure 16:
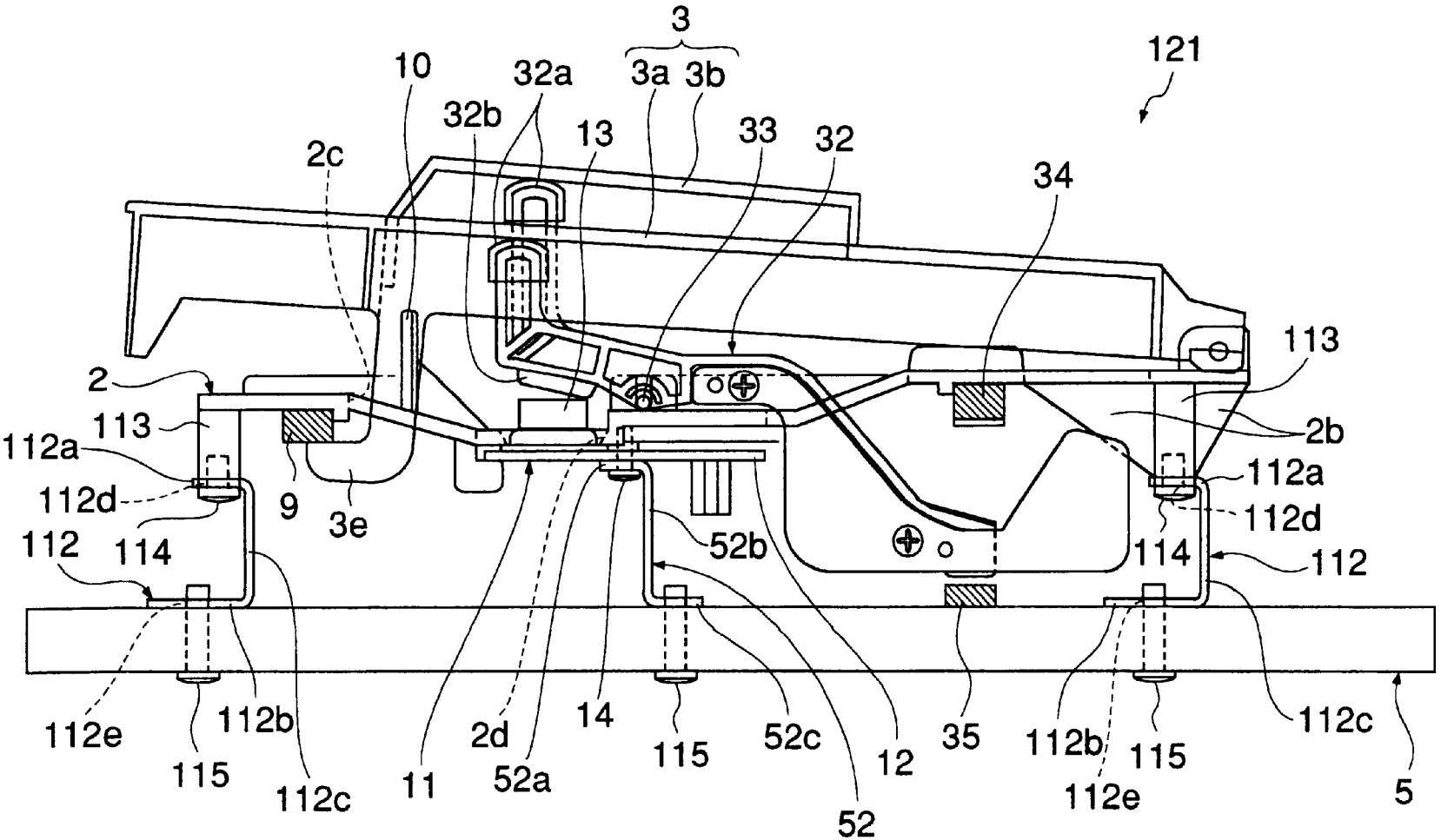
FIG. 16 is a side cross-sectional view of a keyboard device according to a twelfth embodiment.

FIG. 16 illustrates a keyboard device according to a twelfth embodiment of the present invention. The illustrated keyboard device 121 has front and rear coupling members 112 similar to those employed in the eleventh embodiment, in place of the front and rear coupling members 42 of the keyboard device 51 according to the aforementioned fifth embodiment. Chassis 2 are secured to a keybed 5 with screws 115 which are screwed thereinto from the keybed 5 side through the front and rear coupling members 112 and an intermediate coupling member 52. It can therefore be seen that the twelfth embodiment can have completely the same advantage as the eleventh embodiment.

Figure 17:
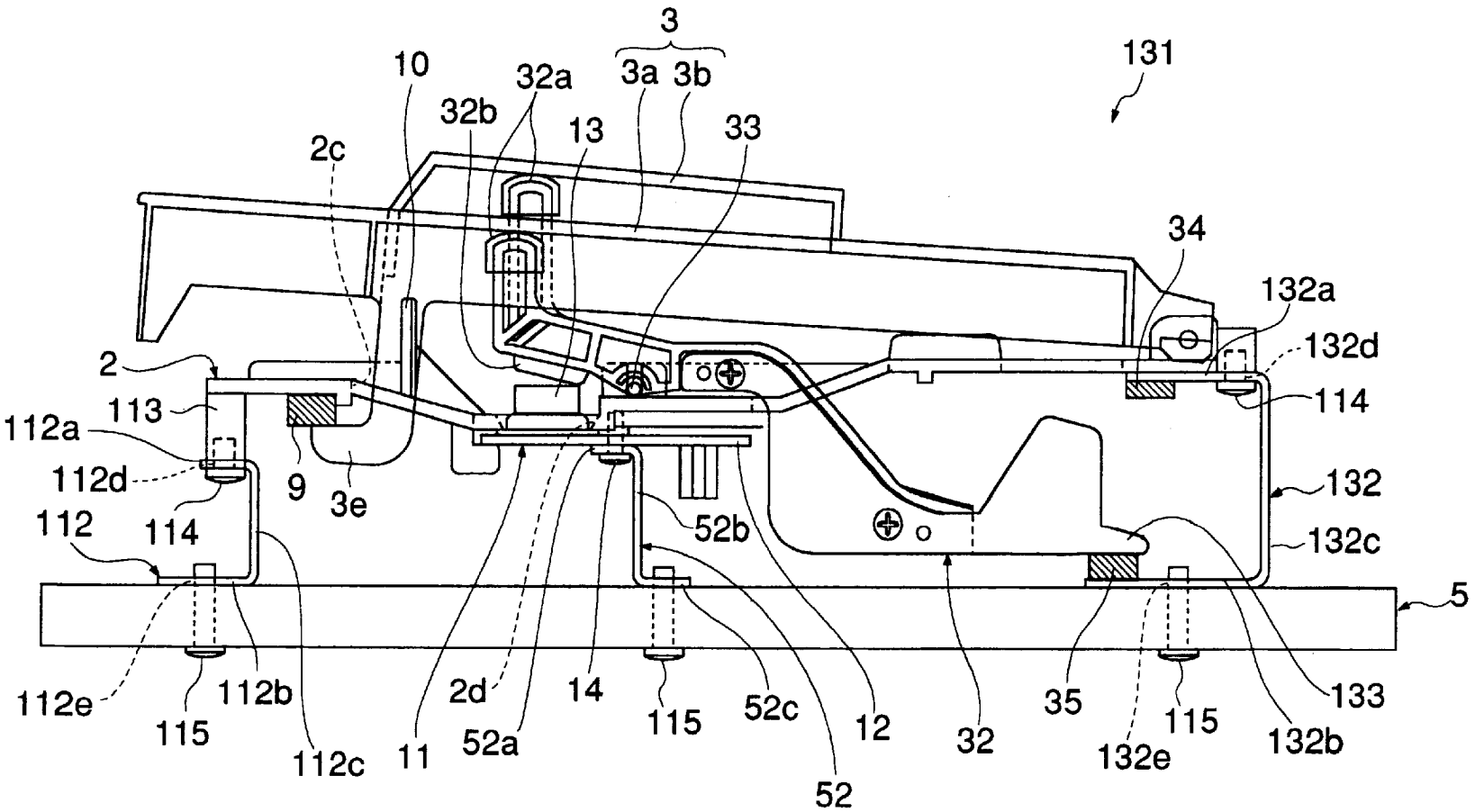
FIG. 17 is a side cross-sectional view of a keyboard device according to a thirteenth embodiment when in a key released state.
Figure 18:
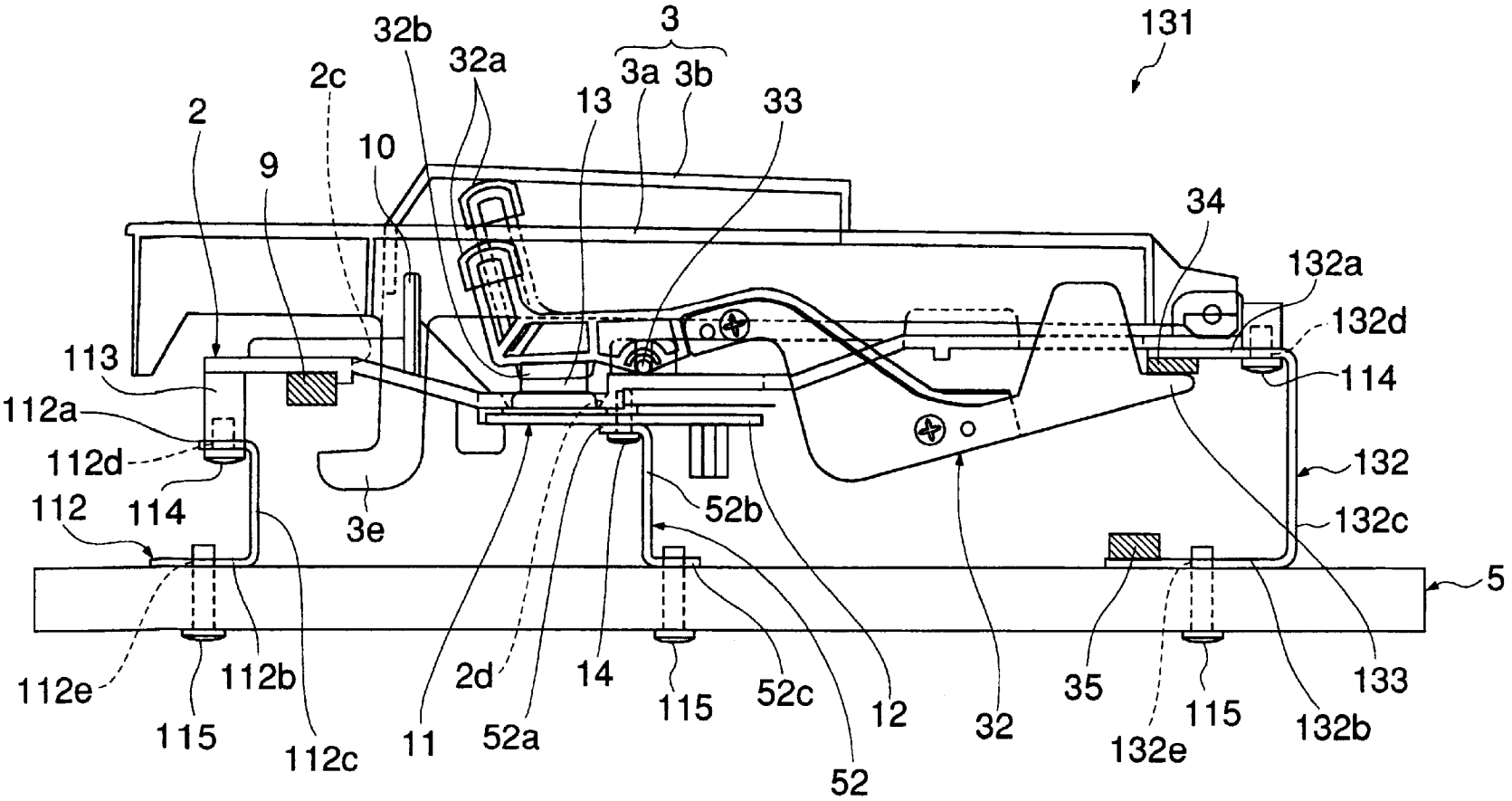
FIG. 18 is a side cross-sectional view of the keyboard device of FIG. 17 when in a key pressed state.

FIGS. 17 and 18 illustrate a keyboard device according to a thirteenth embodiment of the present invention. The illustrated keyboard 131 has a rear coupling member 132 having a larger cross-sectional area disposed in place of the rear coupling member 112 of the keyboard device 121 according to the aforementioned twelfth embodiment. This rear coupling member 132 is provided with upper limit stoppers 34 and lower limit stoppers 35 for regulating the range of pivotal movements of hammers 32. The rear coupling member 132 likewise extends continuously over the entire lengths of chassis 2 and sub-chassis in the left-to-right direction, and formed of an extrusion molding made of aluminum alloy, by way of example.

As illustrated in FIGS. 17 and 18, the rear coupling member 132 is composed of an upper horizontal chassis coupling portion 132*a*, a lower horizontal keybed securing portion 132*b*, and an upright portion 132*c* connecting the two horizontal portions. The rear coupling member 132 couples the chassis 2 with screws 114 which are inserted thereinto through bolt holes 132*d* formed through the chassis coupling portion 132*a*. The rear coupling member 132 itself is secured to the keybed 5 with screws 115 which are screwed into screw holes 132*e* of the keybed securing portion 132*b* from below the keybed 5. In addition, the upper limit stopper 34 is attached on the bottom of the chassis coupling portion 132*a*, while the lower limit stopper 35 is attached on the top of the keybed securing portion 132*b*. Each hammer 32 is formed with a stopper 133 extending backwardly from the rear end thereof. Then, as illustrated in FIGS. 17 and 18, the hammer 32 has the range of pivotal movement regulated by the stopper 133 which abuts to the lower limit stopper 35 and the upper limit stopper 34.

As described above, in the thirteenth embodiment, since the upper limit stoppers 34 and the lower limit stoppers 35 for regulating the range of pivotal movements of the hammers 32 are attached on the single rear coupling member 132 which covers all the hammers 32, all the hammers 32 can be pivoted over a uniform range only by coupling a plurality of chassis 2 with the rear coupling member 132. This eliminates the need for adjustments to the upper and lower stoppers 34, 35 for making uniform the strokes of pivotal movements of all the hammers 32, after the chassis 2 have been coupled, so that the keyboard device 121 can be assembled more easily.

While the foregoing embodiments have been described in connection with an electronic piano to which the keyboard device of the present invention is applied, the keyboard device of the present invention is not limited to the electronic piano but may also be applied to other electronic musical instruments (for example, a synthesizer or the like) and keyboard-based musical instruments of acoustic type. Also, while the chassis 2 has been described as being made of ABS resin, the material for the chassis 2 is not limited to this particular one, but other appropriate synthetic resin (for example, polystyrene, polyacetal or the like), ceramics or the like may be used instead. In addition, the chassis 2 may be manufactured by stamping a steel plate using a press tool, and bending the stamped plate using a bending tool. In this case, manufacturing facilities including tools and a press machine used to manufacture the chassis 2 can be reduced in size, thereby significantly reducing the manufacturing cost of the keyboard device as described above.

Further, in the foregoing embodiments, while the keys 3 have been described as been made of ABS resin, the material for the keys 3 is not either limited to this particular one, but may be made of a metal such as steel, any other appropriate synthetic resin (for example, polystyrene, polyacetal or the like), a woody material, or the like. Furthermore, while a chassis having a V-shaped groove is injection molded by using a lining piece and a mold for the chassis 2 for fabricating the sub-chassis for the lowest sound range and the highest sound range, such a grooved chassis may be fabricated by changing the shape of the mold.

As described above, the keyboard device according to the present invention can realize a significant reduction in manufacturing cost of the keyboard device resulting from a large reduction in manufacturing cost of the chassis, easy assembly of the keyboard device, and a further reduction in the manufacturing cost resulting from a reduction in the number of parts associated with a supporting structure for keys or the like.

What is claimed is:

1. A keyboard device for a keyboard-based musical instrument comprising:

a plurality of chassis arranged in a left-to-right direction; and a plurality of keys, attached to said plurality of chassis for pivotal movements, said keys being arranged in the left-to-right direction.

2. A keyboard device for a keyboard-based musical instrument according to claim 1, wherein at least a portion of said plurality of chassis comprises a plurality of chassis of a single type having the same dimensions and shape.

3. A keyboard device for a keyboard-based musical instrument according to claim 2, wherein said chassis of the single type are combined to be a chassis for carrying keys which span an integer multiple of one octave.

4. A keyboard device for a keyboard-based musical instrument according to any of claims 1 to 3, wherein said plurality of chassis are attached to a main body of said keyboard-based musical instrument.

5. A keyboard device for a keyboard-based musical instrument according to claim 1, further comprising a coupling member for coupling said plurality of chassis to one another.

6. A keyboard device for a keyboard-based musical instrument according to claim 5, further comprising a plurality of resilient springs retained by said coupling means respectively for urging said plurality of keys such that said keys return to respective key released positions.

7. A keyboard device for a keyboard-based musical instrument according to claim 5, wherein each of said plurality of chassis includes engaging means at a predetermined position, and said coupling member includes a plurality of positioning means for positioning said plurality of chassis by engaging said engaging portions of said plurality of chassis at said predetermined positions.

8. A keyboard device for a keyboard-based musical instrument according to claim 7, wherein said engaging means of said plurality of chassis includes projections and/or recesses, and said positioning means of said coupling member includes recesses and/or project ions which are engageable with said projections and/or recesses of said engaging means of said plurality of chassis.

9. A keyboard device for a keyboard-based musical instrument according to claim 5, wherein said coupling member includes a portion extending at least in the vertical direction for suppressing deflection of said plurality of chassis.

10. A keyboard device for a keyboard-based musical instrument according to claim 9, further comprising a printed circuit board attached to said plurality of chassis for detecting key pressing information for said plurality of keys, said coupling member being disposed near said printed circuit board.

11. A keyboard device for a keyboard-based musical instrument according to claim 9 or 10, further comprising a plurality of hammers pivotably supported by respective hammer fulcrums defined on said plurality of chassis, and arranged for pivotal movements in association with said plurality of keys, said coupling member being disposed near said hammer fulcrums.

12. A keyboard device for a keyboard-based musical instrument according to claim 5, further comprising a plurality of hammers pivotably supported by said coupling member, and arranged for pivotal movements in association with said plurality of keys.

13. A keyboard device for a keyboard-based musical instrument according to claim 12, wherein said coupling member includes a single coupling member continuously extending in the left-to-right direction over all of said plurality of hammers.

14. A keyboard device for a keyboard-based musical instrument according to claim 13, wherein said coupling means includes a horizontal attaching portion attached to said plurality of chassis, and a hammer supporting portion extending upwardly from one end of said attaching portion, said hummer supporting portion being formed with alternating engaging projections and engaging recesses along a lengthwise direction of said coupling member for engaging and supporting said plurality of hammers.

15. A keyboard device for a keyboard-based musical instrument according to claim 5, wherein said coupling member includes a printed circuit board for detecting key pressing information for said plurality of keys.

16. A keyboard device for a keyboard-based musical instrument according to claim 5, wherein said coupling means is made of metal, and said keyboard device further comprises screws which are screwed into said coupling means from a main body side of said keyboard-based musical instrument to secure said plurality of chassis to said main body of said keyboard-based musical instrument.

17. A keyboard device for a keyboard-based musical instrument according to claim 5, wherein said coupling means includes a single coupling means continuously extending in the left-to-right direction, and at least one of a plurality of key guides for guiding said plurality of keys to pivot, and key stoppers for regulating the range of pivotal movements of said plurality of keys.

18. A keyboard device for a keyboard-based musical instrument according to claim 5, further comprising a plurality of hammers pivotably attached to said plurality of chassis, and arranged for pivotal movements in association with said plurality of keys, wherein said coupling member includes a single coupling member continuously extending in the left-to-right direction, and hammer stoppers for regulating the range of pivotal movements of said plurality of hammers.

19. A keyboard device for a keyboard-based musical instrument comprising:

a plurality of chassis arranged in a left-to-right direction;

a coupling member extending in the left-to-right direction for coupling said plurality of chassis to one another; and a plurality of keys, attached to said coupling member for pivotal movements, said keys being arranged in the left-to-right direction.

20. A keyboard device for a keyboard-based musical instrument according to claim 19, wherein said coupling member includes a single coupling member continuously extending in the left-to-right direction over all of said plurality of hammers.

21. A keyboard device for a keyboard-based musical instrument according to claim 19 or 20, further comprising a plurality of resilient springs retained by said coupling means respectively for urging said plurality of keys such that said keys return to respective key released positions.

* * * * *